US010480301B2

(12) United States Patent
Mace et al.

(10) Patent No.: US 10,480,301 B2
(45) Date of Patent: Nov. 19, 2019

(54) MULTI-PHASIC EXPLOSIVE FRACTURING SYSTEM

(71) Applicant: Los Alamos National Security, LLC, Los Alamos, NM (US)

(72) Inventors: Jonathan Lee Mace, Los Alamos, NM (US); Bryce C. Tappan, Santa Fe, NM (US); Lawrence E. Bronisz, Los Alamos, NM (US); Jonathan Morgan, Chimayo, NM (US); Patrick Bowden, Los Alamos, NM (US); Daniel Preston, Los Alamos, NM (US); Gerald J. Seitz, El Rancho, NM (US); Nathaniel Morgan, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 159 days.

(21) Appl. No.: 15/316,616

(22) PCT Filed: Jun. 25, 2015

(86) PCT No.: PCT/US2015/037807
§ 371 (c)(1),
(2) Date: Dec. 6, 2016

(87) PCT Pub. No.: WO2016/053428
PCT Pub. Date: Apr. 7, 2016

(65) Prior Publication Data

US 2017/0198560 A1 Jul. 13, 2017

Related U.S. Application Data

(60) Provisional application No. 62/017,206, filed on Jun. 25, 2014.

(51) Int. Cl.
*E21B 43/263* (2006.01)
*E21B 43/248* (2006.01)
(Continued)

(52) U.S. Cl.
CPC ..... *E21B 43/263* (2013.01); *E21B 43/248* (2013.01); *F42D 1/00* (2013.01);
(Continued)

(58) Field of Classification Search
CPC ..... E21B 43/263; E21B 43/268; C06B 47/00; F42D 1/00; F42D 1/10; F42D 1/02
See application file for complete search history.

(56) References Cited

U.S. PATENT DOCUMENTS 4,097,316 A 6/1978 Mullay
4,300,962 A 11/1981 Stinecipher et al.
(Continued)

FOREIGN PATENT DOCUMENTS

WO WO 03/004960 1/2003
WO WO 2013/106850 7/2013

OTHER PUBLICATIONS

International Search Report and Written Opinion for related International Application No. PCT/US2015/037807, 15 pages, dated Aug. 5, 2016.

*Primary Examiner* — Nicole Coy
(74) *Attorney, Agent, or Firm* — Klarquist Sparkman, LLP

(57) ABSTRACT

Disclosed herein are embodiments of precursor components (or compositions thereof) that can be combined with one or more additional components (or compositions thereof) to form an explosive composition. The disclosed precursor components (or compositions thereof) can be handled and transported safely to a particular location where they can be mixed with liquid fuel to form an explosive composition. In particular disclosed embodiments, the precursor components (or compositions thereof) can comprise, consist essentially of, or consist of an oxidizer component, a metal component, or combinations thereof.

20 Claims, 15 Drawing Sheets

(51) Int. Cl.

| | |
|---|---|
| ***F42D 1/00*** | (2006.01) |
| ***F42D 1/10*** | (2006.01) |
| ***F42D 1/02*** | (2006.01) |
| *F42D 1/08* | (2006.01) |
| *E21B 34/06* | (2006.01) |
| *F42D 1/045* | (2006.01) |

(52) U.S. Cl.
CPC ..... *F42D 1/02* (2013.01); *F42D 1/10* (2013.01); *E21B 34/06* (2013.01); *F42D 1/045* (2013.01); *F42D 1/08* (2013.01)

(56) References Cited

U.S. PATENT DOCUMENTS

| | | | | | |
|---|---|---|---|---|---|
| 5,071,496 | A * | 12/1991 | Coursen | ..... | C06B 45/00 102/313 |
| 5,099,763 | A * | 3/1992 | Coursen | ..... | C06B 45/00 102/313 |
| 5,811,726 | A | 9/1998 | Brown et al. | | |
| 2005/0126419 | A1 | 6/2005 | Johnson | | |
| 2012/0103627 | A1 * | 5/2012 | Larssen | ..... | E21B 23/00 166/373 |

* cited by examiner

MULTI-PHASIC EXPLOSIVE FRACTURING SYSTEM

PRIORITY CLAIM

CROSS-REFERENCE TO RELATED APPLICATIONS

This is the U.S. National Stage of International Application No. PCT/US2015/037807, filed Jun. 25, 2015, which was published in English under PCT Article 21(2), and which claims the benefit of U.S. Provisional Patent Application No. 62/017,206, filed Jun. 25, 2014, and titled "Multi-Phasic Explosive Fracturing System." This provisional application is incorporated by reference herein in its entirety.

ACKNOWLEDGMENT OF GOVERNMENT SUPPORT

The claimed invention was made with government support under Contract No. DE-AC52-06NA25396 awarded by the U.S. Department of Energy. The government has certain rights in the claimed invention.

FIELD

The present disclosure concerns embodiments of an explosive composition that can be formulated using particular precursor compositions disclosed herein. Also disclosed are systems and methods for using and implementing the disclosed compositions.

PARTIES TO JOINT RESEARCH AGREEMENT

The research work described here was performed under a Cooperative Research and Development Agreement (CRADA) between Los Alamos National Security, LLS (LANS) and Chevron Energy Technology Company under the LANL-Chevron Alliance, CRADA number LA05C10518.

BACKGROUND

The use of high energy density (HED) sources, such as explosives, for the purpose of stimulating permeability in hydrocarbon reservoirs has been previously investigated; however, the fracture radius away from the borehole with such technologies has never extended for more than a few feet radially from the borehole. Permeability stimulation in tight formations is currently dominated by the process known as hydraulic fracturing. With hydraulic fracturing, chemically treated water is pumped into the reservoir via a perforated wellbore to hydraulically fracture the rock providing a limited network of propped fractures for hydrocarbons to flow into a production well.

Past investigations and present practice of stimulating permeability in tight formations do not take full advantage of the information gained from detailed analysis of both the formation properties and the customization of a HED system to create the largest permeability zone that is economical. Some systems disclosed herein take into account best estimates of the shock wave behavior in the specific geologic formation and can be geometrically configured and adjusted in detonation time to enhance the beneficial mixing of multiple shock waves from multiple sources to extend the damage/rubblization of the rock to economic distances. Shock waves travel with different velocities and different attenuation depending on physical geologic properties. These properties include strength, porosity, density, hydrocarbon content, water content, saturation and a number of other material attributes.

As such, explosive systems, compositions, and methods are disclosed herein which are designed to be used to fracture geologic formations to provide access to energy resources, such as geothermal and hydrocarbon reservoirs. Some disclosed methods and systems, such as those for enhancing permeability in tight geologic formations, involve the beneficial spacing and timing of HED sources, which can include explosives and specially formulated propellants. In some examples, one or more precursor compositions can be combined to produce a powerful and sensitive explosive composition. The precursor compositions disclosed herein can be shipped and/or stored at lower hazard classes than would be required if combined together as the explosive composition.

DETAILED DESCRIPTION

I. Terms, Definitions, and Abbreviations

Figure 1:
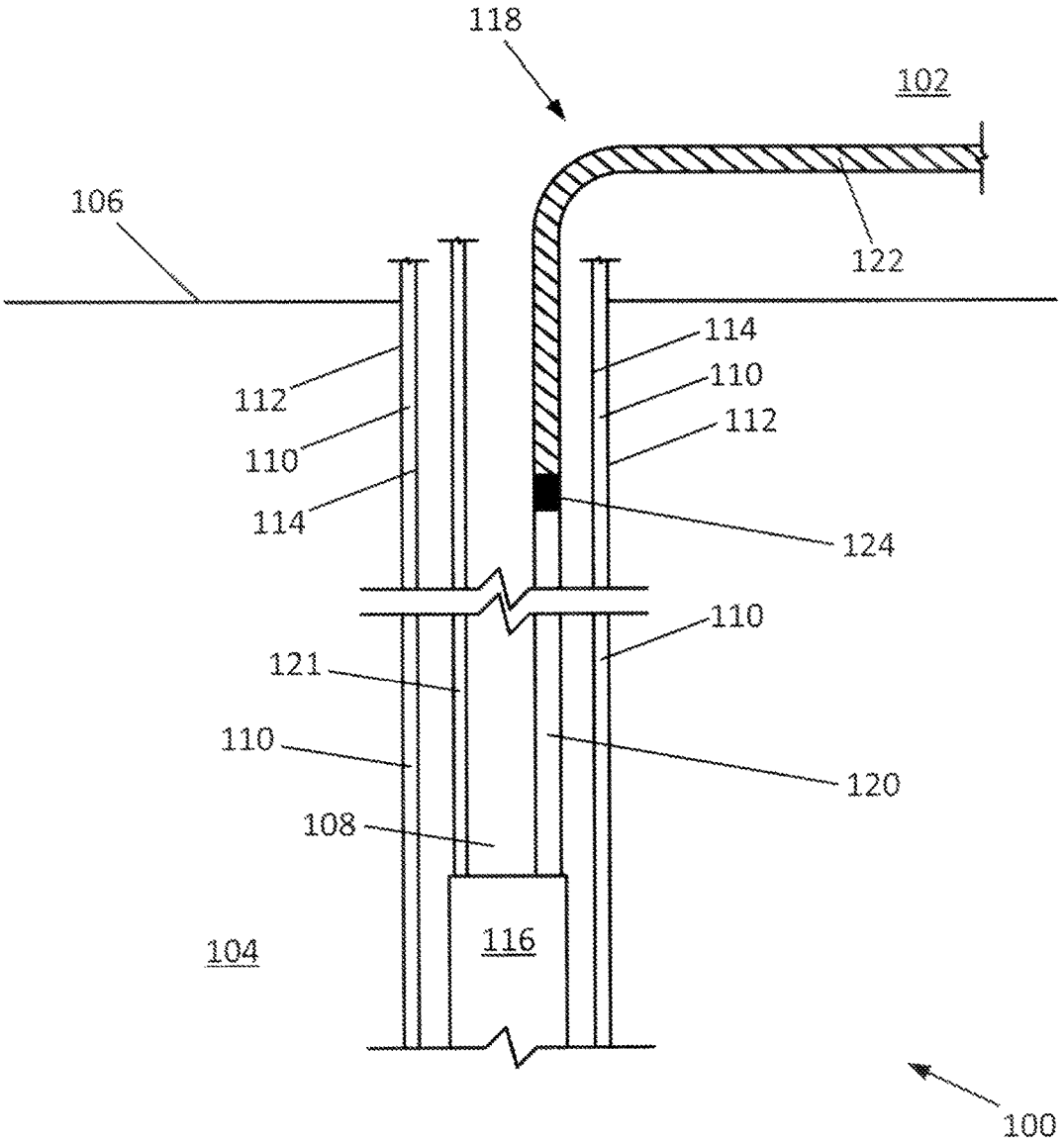
FIG. 1 illustrates an embodiment of a slidable stop used in a wellbore.

As used herein, the term detonation (and its grammatical variations) is not limited to traditional definitions and instead also includes deflagration and other forms of combustion and energetic chemical reactions.

As used herein, the term detonator is used broadly and includes any device configured to cause a chemical reaction, including explosive detonators and propellant initiators, igniters and similar devices. In addition, the term detonation is used broadly to also include detonation, initiation, igniting and combusting. Thus a reference to detonation (e.g. in the phrase detonation control signal) includes detonating an explosive charge (if an explosive charge is present) such as in response to a fire control signal and initiating the combustion of a propellant charge (if a propellant charge is present) such as in response to a fire control signal.

In addition a reference to "and/or" in reference to a list of items includes the items individually, all of the items in combination and all possible sub-combinations of the items. Thus, for example, a reference to an explosive charge and/or a propellant charge means "one or more explosive charges", "one or more propellant charges" and "one or more explosive charges and one or more propellant charges.

As used in this application, the singular forms "a," "an," and "the" include the plural forms unless the context clearly dictates otherwise. Additionally, the term "includes" means "comprises." Further, the term "coupled" generally means electrically, electromagnetically, and/or physically (e.g., mechanically or chemically) coupled or linked and does not exclude the presence of intermediate elements between the coupled or associated items absent specific contrary language.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents. Any combination of embodiments disclosed herein is contemplated by the present disclosure.

Although methods and materials similar or equivalent to those described herein can be used in the practice or testing of the present disclosure, suitable methods and materials are described below. All publications, patent applications, patents, and other references mentioned herein are incorporated by reference in their entirety. In case of conflict, the present specification, including explanations of terms, will control.

Explosive Material: A reactive substance that contains a large amount of potential energy of 3-17 kJ/cm$^{-3}$ (such as chemical energy or pressurized gas) that can produce an explosion if released suddenly, usually accompanied by the production of light, heat, sound, and pressure.

Explosive charge: A measured quantity of an explosive material.

High Performance Explosive: An explosive that generates an explosive shock front which propagates through a material at supersonic speed (e.g., causing a detonation) in contrast to a low performance explosive which instead causes deflagration.

CL-20: 2,4,6,8,10,12-hexanitro-2,4,6,8,10,12-hexaazaisowurtzitane.

DAAF: diaminoazoxyfurazan.

ETN: erythritol tetranitrate.

EGDN: ethylene glycol dinitrate.

FOX-7: 1,1-diamino-2,2-dinitroethene.

GAP: Glycidyl azide polymer.

HMX: octogen, Octahydro-1,3,5,7-tetranitro-1,3,5,7-tetrazocine.

HNS: hexanitrostilbene.

HE: high explosive.

HED: high energy density.

LAX-112: 3,6-diamino-1,2,4,5-tetrazine-1,4-dioxide.

NG: nitroglycerin.

NTO: 3-nitro-1,2,4-triazol-5-one.

PETN: pentaerythritol tetranitrate.

RDX: cyclonite, hexogen, 1,3,5-Trinitro-1,3,5-triazacyclohexane, 1,3,5-Trinitrohexahydro-s-triazine.

TATB: triaminotrinitrobenzene.

TNT: trinitrotoluene.

II. Precursor and Explosive Compositions

Precursor composition embodiments disclosed herein can be developed to provide an explosive chemical composition capable of providing different chemical environments as well as variation in temperature and pressure according to the desired properties, such as according to the specific properties of the geologic formation in which energy resources are to be extracted. The precursor composition embodiments disclosed herein can be used in combination with the disclosed system. In exemplary embodiments, the composition embodiments can be used with the disclosed system in fracturing applications to access certain energy resources, such as oil well fracturing, gas well fracturing, or any other suitable fracturing methods. The precursor compositions disclosed herein can be formulated to provide certain properties prior to their combination with a liquid fuel, such as having low explosive sensitivities and large critical diameters above ground, being capable of passive mixing, or any combination thereof.

Precursor composition embodiments disclosed herein can be configured to provide a powerful and sensitive explosive composition once certain precursor composition components are combined with a separate liquid fuel. In some embodiments, individual precursor compositions can be made that are stable and non-explosive by themselves. In some embodiments, one or more individual precursor compositions can be combined to make a mixed precursor composition. Such mixed precursor compositions also can be stable and non-explosive. Any of the precursor compositions and/or mixed precursor compositions disclosed herein can be made off-site, stored, and/or transported safely to a particular site where they will be used.

The precursor compositions and/or mixed precursor compositions can be stored and/or shipped at particular hazard classes that differ from a hazard class that would be required for an explosive composition (such as an explosive composition comprising any one of the disclosed precursor compositions, or mixed precursor compositions, and further comprising a liquid fuel). The particular hazard classes discussed herein can be based on those set forth by the United States Department of Transportation, or a foreign jurisdiction equivalent thereof. For example, the precursor compositions and/or mixed precursor compositions disclosed herein can be stored and/or shipped at a lower (e.g., less hazardous) hazard class than a 1.1 Explosive hazard class, such as a 1.5 Blasting Agent, Oxidizing Substances and Organic Peroxides hazard class (such as an Oxidizer hazard class), a Flammable Liquid and Combustible Liquid hazard class (such as a Fuel Oil hazard class, a Flammable hazard class, a Combustible hazard class, or a Gasoline hazard class), a Flammable Solid, Spontaneously Combustible, and Dangerous When Wet hazard class, or any combination thereof.

In some embodiments, the disclosed precursor compositions and/or mixed precursor compositions can be mixed with a fuel, such as a liquid fuel, or composition thereof, to form an explosive composition. In some embodiments, the liquid fuel can be mixed with the precursor compositions and/or mixed precursor compositions just prior to detonation of the final explosive composition. For example, a liquid fuel, or composition thereof, can be added to precursor compositions or mixed precursor compositions after such compositions have been placed in a desired location. In some embodiments, a desired location can be below ground (e.g., "down hole"), such as at a distance of 6 feet (1.8 meters) to 20,000 (6.096 km) feet below a ground surface, such as 6 feet (1.8 meters) to 5,000 feet (1.524 km), or 6 feet (1.8 meters) to 1,000 feet (304.8 meters) below ground.

In some embodiments, the precursor compositions disclosed herein can comprise, consist of, or consist essentially of one or more precursor components capable of providing an explosive composition once combined with one or more liquid fuel components. Precursor components that can be included in the precursor composition embodiments include, but are not limited to, an oxidizer, a metal, or a combination thereof. In some embodiments, the oxidizer and/or the metal component can be used neat or they can be used in combination with a solvent.

In some embodiments, the precursor composition can comprise, consist essentially of, or consist of an oxidizer, such as a solid oxidizer. Oxidizer components contemplated herein can comprise an anionic component and a cationic component. Exemplary anionic components include, but are not limited to, perchlorate, chlorate, nitrate, dinitramide, nitroformate, or any combination thereof. Exemplary cationic components include, but are not limited to, ammonium, hydroxylammonium, methylammonium, hydrazinium, guanidinium, amino guanidinium, diaminoguanidinium, triaminoguanidinium, an ion of a Group 1 element of the periodic table (e.g., Li, Na, K, Rb, or Cs), an ion of a Group 2 element of the periodic table (e.g., Mg, Ca, Sr, Ba, or Be), or any combination thereof. Any combination of an anionic component and a cationic component disclosed herein can be used. In some embodiments, more than one oxidizer can be used, with each oxidizer comprising a different anionic and/or cationic component. In exemplary embodiments, the oxidizer can be selected from ammonium nitrate, ammonium perchlorate, hydrazinium mononitrate, or combinations thereof.

The oxidizer component can be a crystalline solid (e.g., an ionic solid or a molecular solid), a polycrystalline solid, or an amorphous solid (e.g., a powder). In particular disclosed embodiments, the oxidizer can be a powder comprising particle sizes that can be selected to provide a particular energy release rate and to facilitate packing and/or mixing of the oxidizer component. For example, smaller particle sizes (such as 1-60 μm, 1-40 μm, or 1-30 μm) can provide faster reaction rates and therefore higher detonation velocities and pressures (such as those approaching the theoretical maximum as determined by thermoequilibrium calculations known to a person of ordinary skill in the art) at smaller charge diameters (e.g., 1-4 inches) than would be achieved with larger particle sizes (such as 60-200 μm, 60-150 μm, or 60-100 μm). In some embodiments, all particles may or may not have the same particle size. In certain embodiment, the particle size of the oxidizer can range from 1 μm to 1000 μm, such as 1 μm to 500 μm, or 1 μm to 250 μm, or 1 μm to 200 μm, or 1 μm to 150 μm, or 1 μm to 100 μm. In exemplary embodiments, the particle size of the oxidizer can range from 10 μm to 200 μm, such as 16 μm to 130 μm, or 60 μm to 130 μm. In exemplary working embodiments, the particle size was 16 μm or 60 μm to 130 μm.

The precursor compositions disclosed herein can comprise, consist essentially of, or consist of a metal component. Metals that are electropositive (such as having a value of 1-2.5 on the Pauling scale, or 1.2-2.0 on the Pauling scale, or 1-1.7 on the Pauling scale) and have high heats of combustion can be used. In some embodiments, the metal component can be a pure metal, a semimetal, an alloy, and/or combinations thereof. The metal component can comprise, consist essentially of, or consist of a metal selected from any one of Groups 2, 4, 5, 8, 10, 13, or 14 of the periodic table of elements. In exemplary embodiments, the metal can be selected from Al, Mg, Ti, Si, B, Ta, Zr, Hf, Fe, Sn, Ni, or combinations thereof. In an independent embodiment, the metal component can be replaced with an inert surrogate. Such independent composition embodiments can be used as a control composition by which the explosive power of explosive compositions disclose herein that do not comprise an inert surrogate can be compared. Exemplary inert surrogates include, but are not limited to, metal halides, such as LiF.

The disclosed metal components can be a crystalline solid (e.g., a metallic solid), a polycrystalline solid, or an amorphous solid (e.g., a powder). In particular disclosed embodiments, the metal component can be a powder comprising particle sizes that can be selected to provide a particular energy release rate and to facilitate packing and/or mixing of the metal component. For example, smaller particle sizes (such as 80 nm to 15 μm, 80 nm to 10 μm, or 80 μm to 5 μm) can provide a faster energy releases after passage of a detonation wave than would be achieved with larger particle sizes (such as 16 μm to 200 μm, 20 μm 100 μm, or 25 μm to 75 μm. In some embodiments, all particles may or may not have the same particle size. In certain embodiments, the metal component can have particle sizes ranging from 1 μm to 50 μm, such as 1 μm to 40 μm, or 1 μm to 30 μm, or 1 μm to 20 μm, or 1 μm to 10 μm, or 1 μm to 5 μm. In exemplary embodiments, the particle size can range from 1 μm to 20 μm, such as 1 μm to 20 μm, or 5 μm to 20 μm. In exemplary working embodiments, the particle size was 5 μm.

In particular disclosed embodiments, an oxidizer component, or composition thereof, can be provided at a particular ratio with respect to the metal component, or composition thereof. For example, in some embodiments, the ratio of oxidizer to metal can range from 49:51 to 89:11, such as 69:31. The amount of the oxidizer component can range from 20 wt % to 80 wt % based on the total weight of an explosive composition, such as 30 wt % to 50 wt % based on the total weight of an explosive composition, or 35 wt % to 45 wt % based on the total weight of an explosive composition. In exemplary embodiments, the amount of the oxidizer can range from 40 wt % to 80 wt %, such as 45 wt % to 75 wt %, or 45 wt % to 73 wt %. In exemplary working embodiments, the amount of the oxidizer used was 45 wt % or 73 wt %. The amount of the metal component can range from 0 wt % to 30 wt % based on the total weight of an explosive composition, such as 5 wt % to 25 wt % based on the total weight of an explosive composition, or 5 wt % to 15 wt % based on the total weight of an explosive composition. In exemplary embodiments, the amount of the metal component can range from 10 wt % to 30 wt %, such as 15 wt % to 25 wt %, or 15 wt % to 20 wt %. In an independent embodiment, the amount of the metal can be at least 15 wt %. In exemplary working embodiments, the amount of the metal component was 15 wt % and 20 wt %.

A precursor composition disclosed herein can be combined with one or more different precursor compositions. For example, a first precursor composition can be combined with a second precursor composition to form a mixed precursor composition. Such mixed precursor compositions can comprise, consist essentially of, or consist of a combination of an oxidizer, or composition thereof, and a metal component, or a composition thereof. An exemplary mixed precursor composition can comprise, consist essentially of, or consist of ammonium perchlorate ($NH_4ClO_4$) and aluminum (Al), ammonium nitrate ($NH_4NO_3$) and aluminum (Al), or hydrazinium mononitrate ($H_2N—NH_3NO_3$) and aluminum (Al). In an independent embodiment, the mixed precursor composition can comprise, consist essentially of, or consist of ammonium perchlorate ($NH_4ClO_4$) and lithium fluoride (LiF). Such mixed precursor compositions can comprise a mixture of the oxidizer and the metal component as disclosed above.

One or more of the precursor components can be combined with one or more liquid fuel components, or compositions thereof that, when combined, form an explosive composition. In some embodiments, the liquid fuel can be a synthetic liquid fuel that is made industrially from two or more non-naturally occurring or naturally occurring reagents (or combinations thereof), wherein the synthetic liquid fuel is markedly different from the non-naturally occurring or naturally occurring reagents. In some embodiments, the liquid fuel component can be selected from nitrated alkanes (such as nitromethane, nitroethane, nitrobutane, or nitropropane), anhydrous or hydrated hydrazines (such as hydrazine, methyl hydrazine, or dimethyl hydrazine), ammonia, or hydroxylamine. In an independent embodiment, the liquid fuel can be selected from nitromethane or hydrazine and does not comprise a nitroazole compound, such as any one of the nitroazole compounds disclosed in U.S. Pat. No. 4,300,962. In some embodiments, the liquid fuel component can be provided in an amount ranging from 5 wt % to 50 wt %, such as 5 wt % to 40 wt %, or 7 wt % to 35 wt %. In exemplary working embodiments, the liquid fuel component was provided at 6.6 wt % or 35 wt %.

The liquid fuel component can be used neat or it can be mixed with one or more additional components, such as an energetic material, an organic solvent, a dispersant, a surfactant, or combinations thereof. Such additional components can be used to modify (e.g., increase or lessen) the explosive or sensitivity properties of the liquid fuel and/or to increase the ability of the liquid fuel to mix with solid forms of the precursor compositions and/or mixed precursor compositions.

Energetic components can be selected from nitro-containing hydrocarbons (e.g., nitroalkyls, such as nitroethane; nitroalkenes, such as FOX-7; or nitroalkynes), glycol-containing nitrates (e.g., ethylene glycol dinitrate (EGDN), NG, ETN, PETN, GAP, or the like), nitroamines (e.g., RDX, HMX, CL-20, or the like), nitro-containing aryls or nitro-containing heteroaryls (e.g., TNT, DNT, NB, HNS, NTO, TATB, or the like), nitric acids, tetrazines (e.g., LAX-112 or the like), hydrazines, or combinations thereof.

Organic solvents can be selected from ethers (e.g., di-t-butyl ether, diethyl ether, diethylene glycol diethyl ether, diglyme, diisopropyl ether, dimethoxyethane, dioxanes, and the like), alcohols (e.g., methanol, ethanol, isopropanol, and the like), acetone, or combinations thereof.

Dispersants can comprise one or more surfactants selected from anionic surfactants, zwitterionic surfactants, nonionic surfactants, and combinations thereof, and one or more solvents. In some embodiments, surfactants can be selected from ammonium lauryl sulfate, sodium lauryl sulfate, sodium laureth sulfate, dioctyl sodium sulfosuccinate, perfluorooctanesulfonate, perfluorobutanesulfonate, sodium stearate, perfluorononoate, perfluorooctanoate, 3-[(3-Cholamidopropyl)dimethylammonio]-1-propanesulfonate, octaethylene glycol monododecyl ether, pentaethylene glycol monododecyl ether, decyl gludoside, lauryl glucoside, octyl glucoside, triton X-100, nonoxynol-9, glyceryl laurate, polysorbate, or combinations thereof.

Exemplary embodiments of the explosive compositions contemplated by the present disclosure include an explosive composition comprising, consisting essentially of, or consisting of ammonium nitrate, aluminum, and nitromethane; an explosive composition comprising ammonium perchlorate, aluminum, and nitromethane; or an explosive composition comprising hydrazinium mononitrate, aluminum, and hydrazine.

The explosive compositions disclosed herein can provide an energy density, once detonated, ranging from 4 kJ/cc to 17 kJ/cc, such as 11 kJ/cc to 15 kJ/cc, or 11 kJ/cc to 14 kJ/cc. In exemplary embodiments, the explosive compositions can provide an energy density of 12 kJ/cc. In particular disclosed embodiments, the detonated explosive composition can produce reactive gases, such as HCl gas, in an amount ranging from 10 g per kg of explosive to 200 g per kg of explosive, such as 100 g per kg of explosive to 139 g per kg of explosive, or 139 g per kg of explosive to 210 g per kg of explosive. The gas produced can thereby contact surrounding surfaces increasing the field stimulation of the explosive composition depending on the geology of the formation. In some embodiments, a gas can be added to the precursor components, or compositions thereof, the mixed precursor compositions, the liquid fuel, or combinations thereof to produce mechanical work that can facilitate the impact of the explosive composition. In particular disclosed embodiments, such gas can be ammonia, but any suitable gas can be used. Gases can be produced by (or provided with) any of the components or compositions disclosed herein.

In some embodiments, the precursor compositions, mixed precursor compositions, and/or the liquid fuel compositions can be free of, or substantially free of air pockets that may interrupt or interfere with the desired explosive impact of the explosive compositions. In some embodiments, a vacuum may be applied to a container comprising the precursor component, or composition thereof, or the mixed precursor composition to remove, or substantially remove, any air or other undesired fluid that may be contained within the container.

Also disclosed herein are combination embodiments comprising, consisting essentially of, or consisting of an oxidizer component, a metal component, or a combination thereof, and a container, such as those disclosed herein, that houses the oxidizer component, the metal component, or combination thereof. Some embodiments can further comprise a detonator and/or a liquid fuel.

III. Methods of Making an Explosive Composition

Also disclosed herein are embodiments of methods for making an explosive composition. The disclosed methods provide the benefit of allowing safe, secure transportation of components, or compositions thereof, that can be combined to provide an explosive composition. The methods disclosed herein also can reduce the costs associated with shipping and preparing explosive compositions as mixing of the precursor composition(s) with a liquid fuel can occur after shipment of the precursor composition(s) thereby reducing shipping costs (such as exportation costs) and preparation costs. In some embodiments, the method comprises combining a first precursor composition with a second precursor composition to form a mixed precursor composition. A liquid fuel can then be added to the mixed precursor composition to make an explosive composition. In some embodiments, a mixed precursor composition can be provided and then mixed with a liquid fuel.

In some embodiments, the first and second precursor compositions can be combined to form a mixed precursor composition prior to transport. In other embodiments, the first and second precursor compositions can be transported separately and then combined at a desired location. In particular disclosed embodiments, the first and second precursor compositions can be combined below ground or they can be combined above ground and then positioned below ground.

Some methods comprise adding the liquid fuel to a mixed precursor composition after it has been placed below ground. Particular system embodiments disclosed herein can be used to facilitate addition of the liquid fuel to the mixed precursor composition. In an independent embodiment, the liquid fuel is not added to the oxidizer composition prior to the addition of the composition comprising the metal component.

In some embodiments, the method can comprise combining a first precursor composition to a second precursor composition (or vice versa) at the particular ratios disclosed herein. Some embodiments can be combined on a small scale (e.g., less than 2000 grams) or on a large scale (e.g., more than 2000 grams). The precursor components can be mixed together by hand on a small scale, such as by using a mixer or by shaking, or they can be mixed together by using spherically-aligned nozzles on a large scale. The liquid fuel can then be poured into the mixed precursor composition or it can be dispersed in the mixed precursor composition.

In embodiments comprising liquid fuel compositions comprising one or more additional components disclosed above, the liquid fuel and the additional component(s) can be combined prior to addition of the liquid fuel to the precursor compositions or mixed precursor compositions. In other embodiments, the additional components can be added before or after the liquid fuel has been combined with the precursor compositions or mixed precursor compositions.

IV. System

A. Container Systems for use with Explosive Fracturing Systems and Methods

Figure 10:
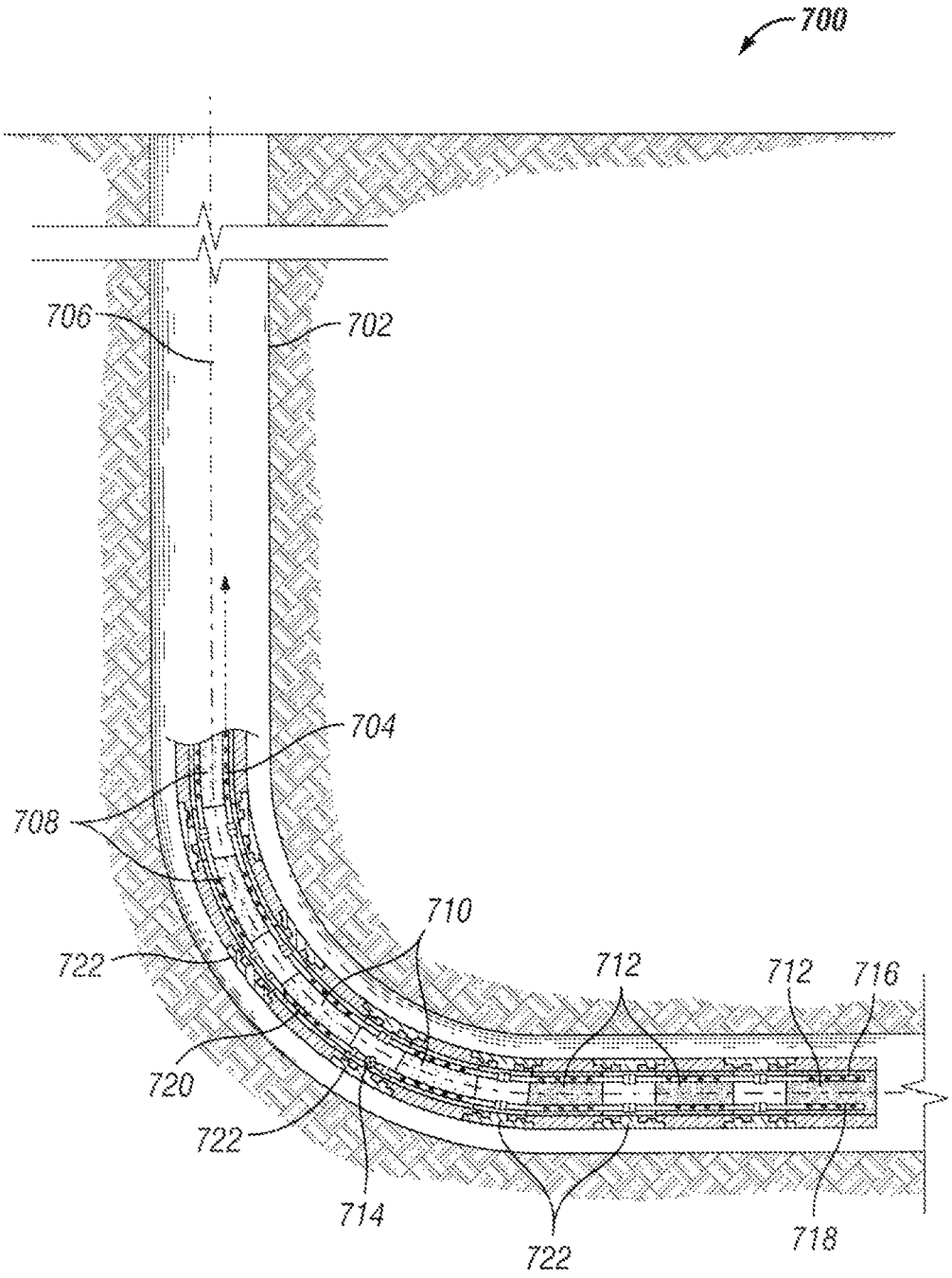
FIG. 10 illustrates containers for use in explosive fracturing systems.

FIG. 10 illustrates a system 700 of containers for use with explosive fracturing systems and methods. FIG. 10 illustrates various components of the system 700 situated within a borehole 702. The system 700 includes one or more liquid supply tanks or containers 708, one or more venting tanks or containers 710 for holding excess materials such as excess liquids, and one or more multiphase explosive containers 712. While the system 700 shows a specific embodiment with a specific number of each container and with the containers in a specific order (e.g., the containers 708 proximal to the containers 710 and the containers 710 proximal to the containers 712), any suitable number of each container, and any suitable ordering of the containers can be used. As used in this section, "distal" and "proximal" are relative terms, wherein distal indicates a location within a borehole that is farther from a ground surface, and proximal means a location within a borehole that is closer to the ground surface.

System 700 also includes a control cable 706 which can include various components for controlling the operation of the system 700, such as the proximal and/or distal motion of the containers 708, 710, 712, the detonation of the system 700, and/or the pumping of fluid through the system 700. System 700 also includes a proximal escape pipe 704 extending from the container 710 to the ground surface, a distal escape pipe 716 coupling the containers 712 to the container 710, a proximal supply pipe 720 for supplying liquid from the containers 708 to a valve and pump assembly 714, and a distal supply pipe 718 for supplying liquid from the assembly 714 to the containers 712. System 700 also includes container coupling mechanisms 722 which can couple adjacent containers to one another.

In use, the system 700 can be positioned down the borehole 702. The containers 708 can initially contain, for example, a liquid fuel, the containers 710 can initially be empty, and the containers 712 can initially contain one or more precursor compositions. Once the system 700 is situated at a desired location in the borehole 702, the control cable 706 can be used to actuate the assembly 714 to open a valve and allow the liquid to flow from the containers 708 into the containers 712. In some cases, the liquid can flow through the proximal supply pipe 720 to the assembly 714, and the assembly 714 can pump the liquid from the containers into the containers 712 through the distal supply pipe 718.

As the liquid moves from the containers 708 to the containers 712, excess gases initially contained within the containers 712 can flow through the distal escape pipe 716 to the container 710, where they can be stored. In some cases, excess liquid moved into the containers 712 can also flow through the distal escape pipe 716 to the container 710, where it can be stored. In some cases, the materials stored in the container 710 can remain there until the system 700 is detonated. This increases safety because the materials need not be moved back to the ground surface. This also makes the operation of the system 700 simpler, as moving the materials back up the borehole can require significant energy to overcome the head pressures. In other embodiments, however, the materials stored within the container 710 can be moved to the ground surface, e.g., by pumping through the proximal escape pipe 704.

The system 700 can be used in combination with any other portions of this disclosure. For example, any of the fuels and/or precursors disclosed herein can be used in system 700. As another example, a fuel feed pipe can be used instead of the containers 708, and the fuel feed pipe can include a dissolving slidable stop as described elsewhere herein. As another example, the container coupling mechanisms 722 can include tape joints as described elsewhere herein. As other examples, the system 722 can include one or more shock conditioning shells, detonation systems, and/or spline systems, as described elsewhere herein.

In some cases, system 700 can include a feed pipe (not illustrated) extending from the ground surface to one or more of the containers 708. In such an embodiment, the containers 708 can act as a staging reservoir for the liquid.

B. Dissolving Slidable Stop for use with Explosive Fracturing Systems and Methods FIG. 1 illustrates components of an explosive fracturing system 100. System 100 includes an explosive fracturing tool 116 situated below ground within a borehole 108. The borehole 108 extends from a first location above a ground surface 106 to a second location below the ground surface 106. An annular well wall or casing 110 can be situated to separate an internal space of the borehole 108 from a geologic formation 104 from which resources are to be extracted. For example, the well casing 110 can have an exterior surface 112 in contact with the geologic formation 104 and an interior surface 114 exposed to the internal space of the borehole 108. One or more tubes, pipes, conduits, cables, or other items can extend from above the ground surface 106 to the tool 116. For example, a fuel feed pipe 118 can extend from a location above the ground surface (e.g., at 102), down the borehole 108 to the tool 116. As another example, a waste escape pipe 121 can extend from the tool 116, up the borehole 108, to a location above the ground surface.

A dissolving slidable stop 124 can be situated within the fuel feed pipe 118. The slidable stop 124 can have a size sufficient to block or substantially block, plug, or seal the fuel feed pipe 118. For example, the slidable stop 124 can have a diameter equal to or larger than an inside diameter of the fuel feed pipe 118 such that it fits snugly within the pipe 118. In some cases, the diameter of the slidable stop 124 is larger than the diameter of the pipe 118 and the slidable stop 124 is compressed before or while being situated within the pipe 118, so as to improve a seal formed between the slidable stop 124 and the pipe 118. The slidable stop 124 can have an exterior surface formed of a material having a selected static and/or dynamic coefficient of friction. For example, the slidable stop 124 can have a coefficient of friction selected such that frictional engagement of the exterior surface of the slidable stop 124 and the interior surface of the pipe 118 resists a selected amount of force while the slidable stop 124 is stationary or moving within the pipe 118.

When the system 100 is in use, the slidable stop 124 can be situated within the pipe 118 to separate a portion of the pipe filled with liquid fuel 122 from a portion of the pipe not filled with fuel 122, for example, a portion of the pipe 118 filled with air 120. The portion of the pipe 118 filled with fuel 122 can be above the slidable stop 124, near the top of the borehole 108, and extending out of the borehole 108 above the ground surface 106, for example, to a pump and/or source of the fuel 122. The portion of the pipe 118 filled with air 120 can be below the slidable stop 124 and extend to the tool 116. As fuel is pumped into the portion of the pipe 118 filled with fuel 122, the fuel 122 can push the slidable stop 124 along the pipe 118 toward the tool 116, while the air 120 in the pipe 118 can be allowed to travel back up the borehole 108, for example, through the waste escape pipe 121. The frictional engagement of the respective surfaces of the slidable stop 124 and the pipe 118 can act to slow the flow of the fuel 122 through the pipe 118 toward the tool 116. In this way, the dissolving slidable stop 124 can reduce or eliminate the risk that fuel 122 falling down the pipe 118 and the borehole 108 explodes, ignites, or results in other complications upon reaching the tool 116, which, in some cases, includes one or more precursor compositions.

The dissolving slidable stop 124 can comprise one or more materials. For example, as noted above, the slidable stop 124 can comprise a material having a selected coefficient of friction. As another example, the slidable stop 124 can comprise a material having a composition configured to dissolve at a selected rate when exposed to the liquid fuel 122. For example, the slidable stop 124 can comprise a quantity of a material configured to dissolve when exposed to the fuel 122 at a rate such that, based on a length of the pipe 118 and a rate at which the fuel 122 is pumped through the pipe 118, the quantity of the material dissolves in the amount of time it takes the slidable stop 124 to reach the tool 116. As another example, the slidable stop 124 can comprise a quantity of a material similarly configured such that the quantity of the material dissolves in one and a half, or twice, or three times, or five times, the amount of time it takes the slidable stop 124 to reach the tool 116. As another example, the slidable stop 124 can comprise a quantity of a material similarly configured such that the quantity of the material dissolves in one minute, two minutes, five minutes, ten minutes, fifteen minutes, twenty minutes, thirty minutes, or one hour when exposed to the fuel 122. As another example, the slidable stop 124 can comprise a quantity of a filler material which dissolves rapidly (e.g., nearly instantaneously, or within a few seconds) when exposed to the fuel 122.

Figure 2:
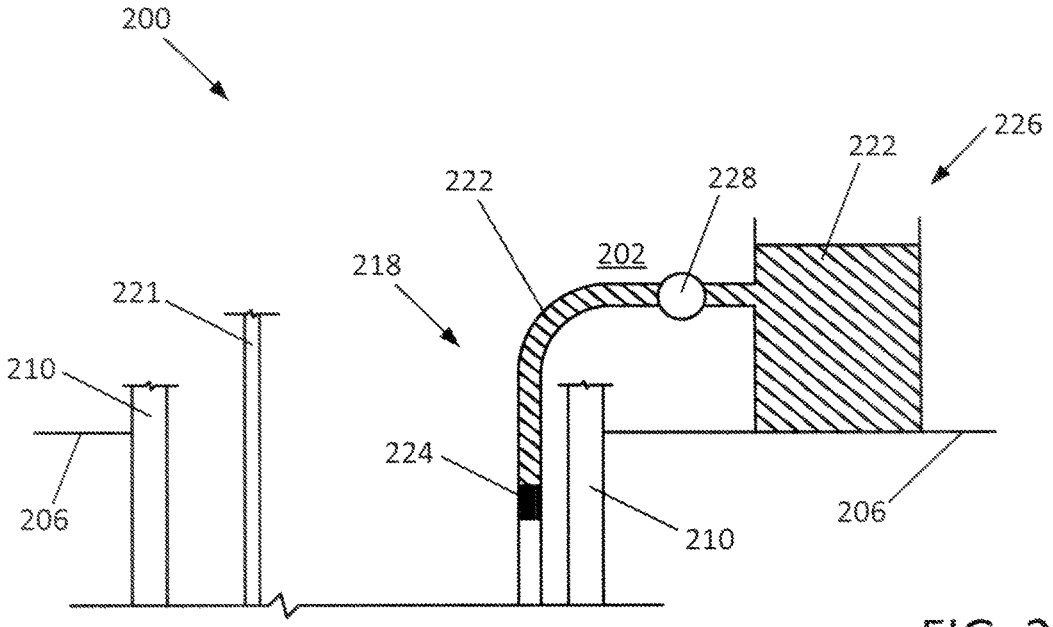
FIG. 2 illustrates a second embodiment of a slidable stop used in a wellbore.
Figure 3:
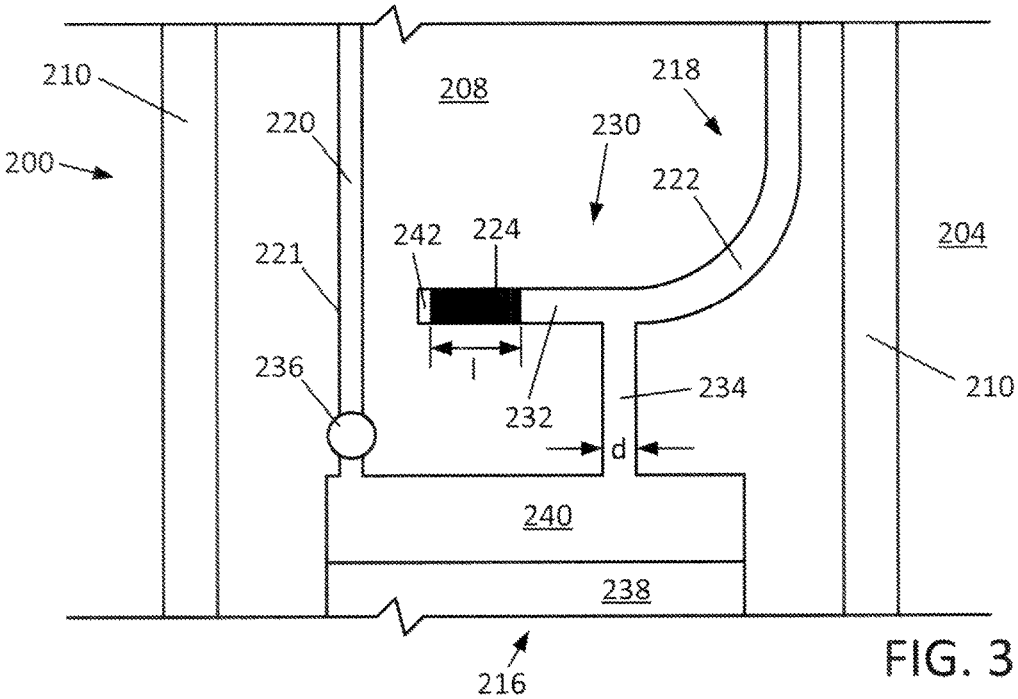
FIG. 3 illustrates a slidable stop docking station.

FIGS. 2 and 3 illustrate components of another explosive fracturing system 200. System 200 includes an explosive fracturing tool 216 situated below ground within a borehole 208. The borehole 208 extends from a first location above a ground surface 206 to a second location below the ground surface 206. An annular well wall or casing 210 can be situated to separate an internal space of the borehole 208 from a geologic formation 204 from which resources are to be extracted. The system 200 includes a fuel feed pipe 218 extending from a location 202 above the ground surface 206 down the borehole 208 to the tool 216, and a waste escape pipe 221 extending from the tool 216 up the borehole 208 to a location above the ground surface 206.

FIG. 2 illustrates that the system 200 can include a fuel tank 226 situated on the ground surface 206 and retaining a supply of fuel 222. The system 200 can also include a pump 228 fluidly coupled to the fuel tank 226 such that the pump 228 can pump fuel 222 from the tank 226 into the pipe 218. The system 200 can also include a slidable stop 224 which can have characteristics similar to the slidable stop 124, and a length l. The pump 228 can pressurize the fuel 222 in the pipe 218 such that the fuel 222 exerts a pressure against the slidable stop 224 sufficient to overcome the frictional engagement of the slidable stop 224 and the pipe 218 such that the slidable stop 224 and fuel 222 travel along the pipe 218 toward the tool 216.

FIG. 3 illustrates that the system 200 can include a docking station 230 for the slidable stop 224, which can include a slidable stop-storage portion 232 and a coupling portion 234 coupling the pipe 218 to the tool 216. The coupling portion 234 can have a width or a diameter d, which can be smaller than the length l of the slidable stop 224. The system 200 can also include a valve or other sealable element 236, which can be actuated to allow gases such as air 220 and/or liquids to pass through it, and which can be actuated to prevent gases and/or liquids from passing through it. The tool 216 can include a precursor composition 238 and an open chamber 240 for receiving the fuel 222. The precursor 238 can be exposed to the chamber 240, or can be separated from the chamber 240, such as by a membrane, wall, or other element. In some cases, the tool can include mixing elements suitable to mix the fuel 222 and the precursor 238 when the fuel 222 is received in the chamber 240.

When the system 200 is in use, the pump 228 can pump fuel 222 into the pipe 218 to push the slidable stop 224 through the pipe 218 toward the tool 216. As the fuel 222 is pumped into and the slidable stop 224 is pushed through the pipe 218, the valve 236 can remain open such that air 220 in the pipe 218 below the slidable stop 224 can escape through the waste escape pipe 221. When the slidable stop 224 reaches the docking station 230, the slidable stop 224 can travel through the pipe 218 into the slidable stop-storage portion 232. Because the diameter d of the coupling portion 234 is larger than the length l of the slidable stop 224, the slidable stop 224 will not enter the coupling portion 234 and instead will travel into the slidable stop-storage portion 232, where it can come to rest. In some cases, the storage portion 232 can have a length of about 6". Once the slidable stop 224 passes the coupling portion 234, the liquid fuel 222 can travel through the coupling portion 234 and into the open chamber 240. When a desired or predetermined or sufficient amount of fuel 222 has reached the chamber 240, the valve 236 can be closed so as to prevent any fuel escaping through the waste escape pipe 221. The fuel 222 can then be allowed to mix or be actively mixed with the precursor 238.

In some cases, a dissolvable slidable stop, as described above, can be used without a docking station, as described above. In other cases, a docking station can be used with a non-dissolvable slidable stop. In some cases, a dissolvable slidable stop can be used in combination with a docking station. Use of a dissolvable slidable stop rather than a non-dissolvable slidable stop can reduce the chance of a blockage of the fuel feed pipe (e.g., 118) during loading of the tool (e.g., 116).

The slidable stop 224 can comprise any of various suitable materials. In some cases, the slidable stop 224 comprises materials configured such that the slidable stop 224 is sufficiently malleable to travel through curved portions of the pipe 218. In some cases, the system 200 can include a second waste escape pipe to allow air to escape from a terminal end portion 242 of the slidable stop-storage portion 232. In some cases, the second waste escape pipe can be coupled to the waste escape pipe 221 such that air escaping from the terminal end portion 242 and through the valve 236 travel up the borehole through the same pipe 221. As noted above, in some embodiments, the slidable stop 224 has characteristics similar to the slidable stop 124. Thus, in some embodiments, the slidable stop 224 can comprise a material having a composition configured to dissolve at a selected rate when exposed to the fuel 222. In other embodiments, however, the slidable stop 224 is not dissolvable by the fuel 222.

In general, a slidable stop (also sometimes referred to as a "pig") is any piece of solid material which can be situated within and travel through a pipe while sealing or substantially sealing the pipe by preventing fluid in the pipe from flowing past it. FIGS. 4A-4G illustrate several different slidable stop configurations. Any of the slidable stops shown in FIGS. 4A-4G can be used in combination with system 100 or system 200.

Figure 4A:
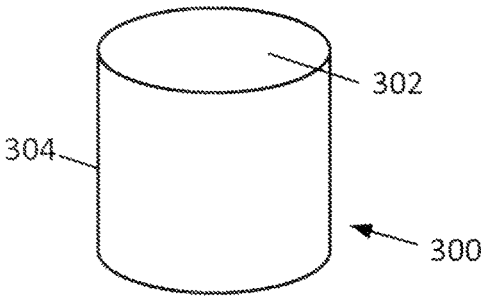
FIGS. 4A-G illustrate embodiments of a dissolvable slidable stop.

FIG. 4A illustrates a perspective view of a first slidable stop 300 comprising a solid piece of a single material 302. As noted above, the material 302 can have a composition configured to dissolve at a selected rate when exposed to a selected liquid fuel. As also noted above, an outer surface 304 of the material 302 can have a coefficient of friction selected such that frictional engagement of the exterior surface 304 of the first slidable stop 300 and the interior surface of a pipe such as pipe 118 or pipe 218 resists a selected amount of force while the slidable stop 300 is stationary or moving within the pipe.

Figure 4B:
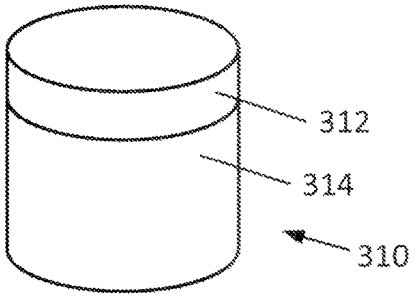

FIG. 4B illustrates a perspective view of a second slidable stop 310 comprising a solid piece of material 312 having a composition configured to dissolve at a selected rate when exposed to a selected liquid fuel. Slidable stop 310 also comprises a filler material 314 configured to dissolve rapidly when exposed to the selected liquid fuel. An outer surface of the material 312 and/or the material 314 can have a coefficient of friction selected such that frictional engagement of the exterior surface of the second slidable stop 310 and the interior surface of a pipe such as pipe 118 or pipe 218 resists a selected amount of force while the slidable stop 310 is stationary or moving within the pipe. In some cases, when the slidable stop 310 is in use, the material 312 is inserted into the pipe first and therefore becomes the bottom of the slidable stop 310 in the pipe, and is not in contact with the selected liquid fuel until the material 314 dissolves. In other cases, when the slidable stop 310 is in use, the material 314 is inserted into the pipe first and therefore becomes the bottom of the slidable stop 310 in the pipe, and is not in contact with the selected liquid fuel until the material 312 dissolves.

Figure 4C:
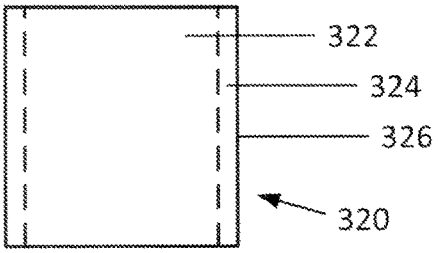

FIG. 4C illustrates a side view third slidable stop 320 comprising an inner solid piece of material 322 having a composition configured to dissolve at a selected rate when exposed to a selected liquid fuel. Slidable stop 320 also comprises an outer solid piece of material 324 having an outer surface 326 having a coefficient of static and/or dynamic friction selected such that frictional engagement of the exterior surface 326 of the third slidable stop 320 and the interior surface of a pipe such as pipe 118 or pipe 218 resists a selected amount of force while the slidable stop 320 is stationary or moving within the pipe. In some cases, the outer solid piece of material 324 is not dissolvable by the selected liquid fuel.

Figure 4D:
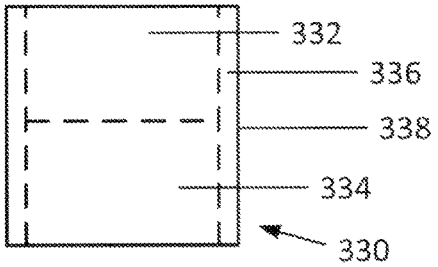

FIG. 4D illustrates a side view of a fourth slidable stop 330 comprising a first inner solid piece of material 332 having a composition configured to dissolve at a selected rate when exposed to a selected liquid fuel. Slidable stop 330 also comprises a second inner solid piece of filler material 334 configured to dissolve rapidly when exposed to the selected liquid fuel. In some cases, when the slidable stop 330 is in use, the material 332 is inserted into the pipe first and therefore becomes the bottom of the slidable stop 330 in the pipe, and is not in contact with the selected liquid fuel until the material 334 dissolves. In other cases, when the slidable stop 330 is in use, the material 334 is inserted into the pipe first and therefore becomes the bottom of the slidable stop 330 in the pipe, and is not in contact with the selected liquid fuel until the material 332 dissolves. Slidable stop 330 also comprises an outer solid piece of material 336 having an outer surface 338 having a coefficient of static and/or dynamic friction selected such that frictional engagement of the exterior surface 338 of the third slidable stop 330 and the interior surface of a pipe such as pipe 118 or pipe 218 resists a selected amount of force while the slidable stop 330 is stationary or moving within the pipe. In some cases, the outer solid piece of material 334 is not dissolvable by the selected liquid fuel.

Figure 4E:
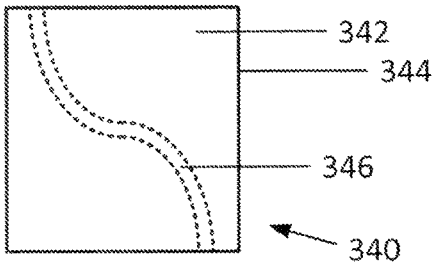

FIG. 4E illustrates a side view of a fifth slidable stop 340. Slidable stop 340 comprises an outer solid piece of material 342 having an outer surface 344 having a coefficient of static and/or dynamic friction selected such that frictional engagement of the exterior surface 344 of the fifth slidable stop 340 and the interior surface of a pipe such as pipe 118 or pipe 218 resists a selected amount of force while the slidable stop 340 is stationary or moving within the pipe. In some cases, the outer solid piece of material 342 is not dissolvable by the selected liquid fuel. The outer solid piece of material 342 includes a channel formed therein, which can be filled with a material 346 having a composition configured to dissolve at a selected rate when exposed to a selected liquid fuel.

Figure 4F:
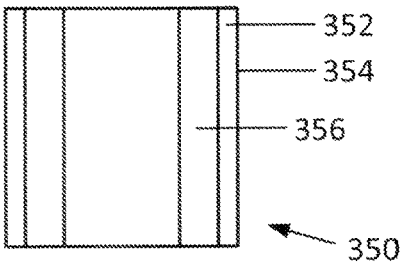
Figure 4G:
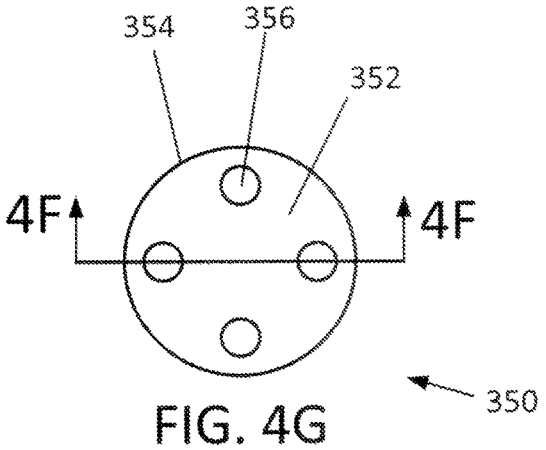

FIGS. 4F and 4G show side and top views, respectively, of a sixth slidable stop 350. FIG. 4F shows a cross-sectional view of slidable stop 350, taken along line 4F-4F, illustrated in FIG. 4G. Slidable stop 350 comprises an outer solid piece of material 352 having an outer surface 354 having a coefficient of static and/or dynamic friction selected such that frictional engagement of the exterior surface 354 of the fifth slidable stop 350 and the interior surface of a pipe such as pipe 118 or pipe 218 resists a selected amount of force while the slidable stop 350 is stationary or moving within the pipe. In some cases, the outer solid piece of material 352 is not dissolvable by the selected liquid fuel. The outer solid piece of material 352 includes four channels formed therein, each of which can be filled with a material 356 having a composition configured to dissolve at a selected rate when exposed to a selected liquid fuel. In some embodiments, the channels can be filled with different materials. In some embodiments, fewer than or more than four channels can be used.

FIGS. 4A-4G illustrate several suitable slidable stops. Various alternative embodiments are suitable and can be used. In some cases, a slidable stop can be configured such that at least a portion of its exterior surface has a coefficient of friction selected such that frictional engagement of the exterior surface of the slidable stop and the interior surface of a pipe such as pipe 118 or pipe 218 resists a selected amount of force while the slidable stop is stationary or moving within the pipe. In some cases, a slidable stop can include at least one channel filled with a material having a composition configured to dissolve at a selected rate when exposed to a selected liquid fuel.

In some cases, a length of the slidable stop can increased to increase the amount of time it takes the slidable stop to dissolve. In some cases, a length of the slidable stop can be decreased to decrease the amount of time it takes the slidable stop to dissolve. In some cases, a length of a slidable stop can be between about ½" and 24", or between about 1" and 12", or between about 2" and 8"

In some cases, frictional engagement between a slidable stop and a feed pipe can be sufficient to resist up to 1500 psi.

In some cases, an inside diameter of a feed pipe and a diameter of a slidable stop can be about 1 inch.

In some cases, a pump such as pump 228 can initially pressurize fuel in a feed pipe behind the slidable stop. In some cases, this initial pressure can be reduced as the slidable stop moves down the feed pipe and pressure of the fuel in the pipe behind the slidable stop builds under gravity.

Materials which can be used to fabricate a portion of the slidable stop that is to dissolve at a desired rate can include ABS plastic, Buna N (Nitrile), Fluorocarbon (FKM), Neoprene, NORYL, Polycarbonate, Polyurethane, Silicone, Viton, methacrylate plastics, nitrocellulose, polyvinyl alcohol nitrate, polystyrene, or combinations thereof.

In some cases, a permeable sintered metal, or a metal filtration material can be situated within a feed pipe such as feed pipe 118 or 218, for example, rather than using a slidable stop. Such a material can slow the flow of fluid (e.g., fuel) through the feed pipe.

Figure 5:
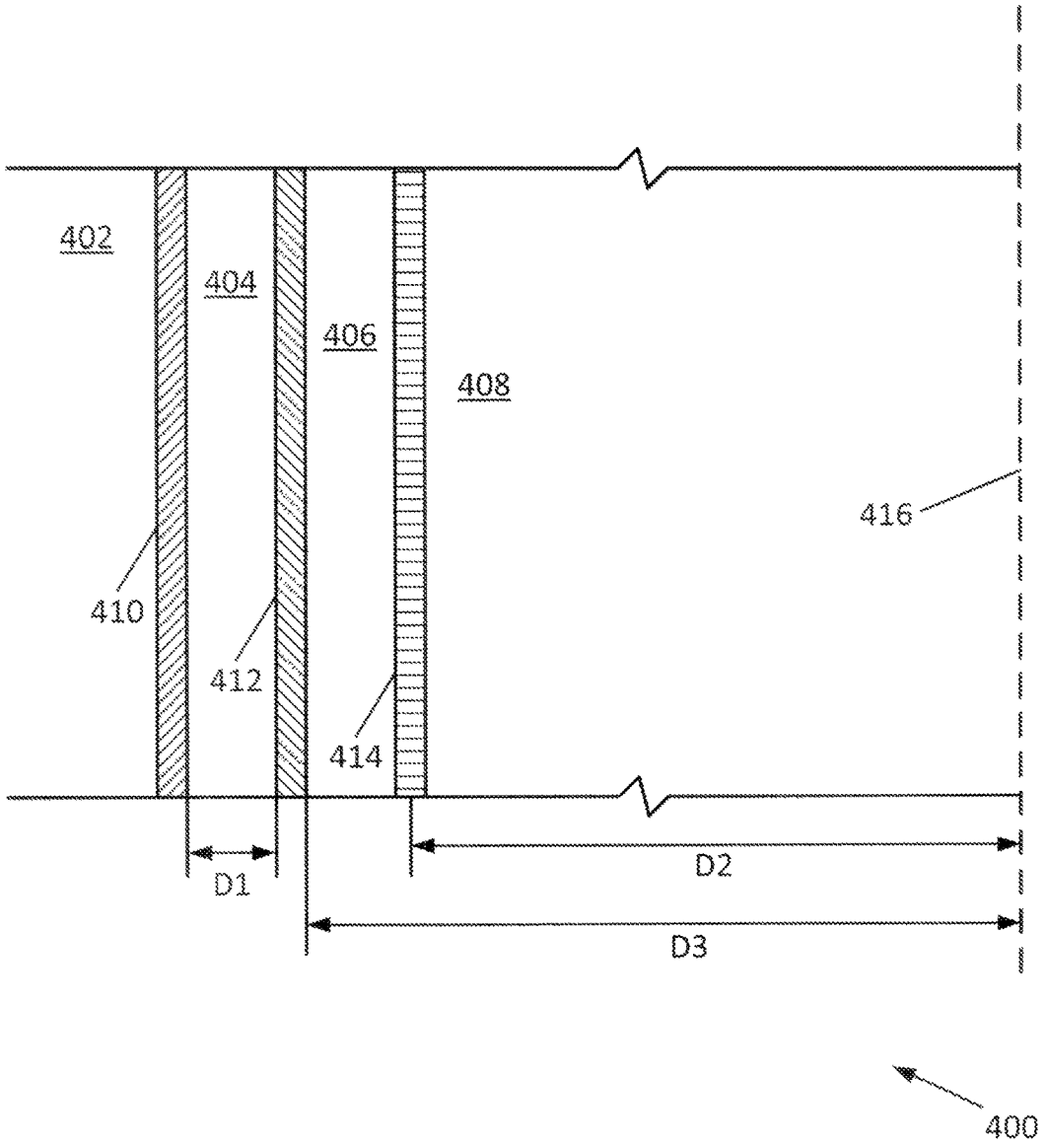
FIG. 5 illustrates a shock conditioning shell for use in explosive fracturing systems.

C. Shock Conditioning Shell for use with Explosive Fracturing Systems and Methods FIG. 5 illustrates a cross sectional view of components of an explosive fracturing system 400. System 400 includes an explosive fracturing tool situated below ground within a borehole. The explosive fracturing tool comprises an annular tool casing 412 and an annular shock conditioning shell 414, and the borehole comprises an annular well casing 410. The tool casing 412, shell 414, and well casing 410 can comprise generally concentric, hollow cylindrical, annular shapes having a central longitudinal axis or centerline 416. The shell 414 can comprise a thin-walled metal shell 414, and in some cases, a ⅛" steel shell 414. The well casing 410 can separate a geologic formation 402, from which resources are to be extracted, from an internal space of the borehole housing, for example, a drilling fluid 404. The tool casing can house an HE material or precursor 406 and 408, such as a high explosive material or precursor as described elsewhere herein.

It has been found that a shock conditioning shell such as shell 414 can dramatically improve the performance of explosive fracturing systems. For example, it has been found that a shock conditioning shell can improve (e.g., increase) an amplitude and a duration of a shock wave generated by detonation of the HE material within the tool casing 412. While the technology is not limited to any particular theory of operation, it is believed that a shock conditioning shell can improve the performance of an explosive fracturing system at least by increasing the degree to which transmitted portions of the initial shock wave constructively interfere with reflected portions of the initial shock wave.

For example, when the HE material 406, 408 is detonated, an initial shock wave is created which moves outward from the center of the tool casing 412. A primary portion of this initial shock wave can be transmitted through the tool casing 412, through the drilling fluid 404, through the well casing 410, and outward into the geologic formation 402. A secondary portion of the initial shock wave can also be reflected by the tool casing 412 (e.g., at an interface between the casing 412 and the HE material 406), drilling fluid 404 (e.g., at an interface between the casing 412 and the fluid 404), the well casing 410 (e.g., at an interface between the fluid 404 and the well casing 410), and/or the geologic formation 402 (e.g., at an interface between the casing 410 and the geologic formation 402). Similarly, a primary portion of each of these reflected portions of the initial shock wave can be transmitted through back through the respective layers of material and outward into the geologic formation 402, while a secondary portion of each of these reflected portions of the initial shock wave can be reflected a second time. This process can be repeated until the reflected waves subside.

In this way, a detonation of the HE material 406, 408, can produce a plurality of shock waves, some of which are the product of one or more reflections. The net effect of the plurality of the shock waves on the geologic formation 402 can depend on the extent to which the shock waves constructively, rather than destructively, interfere with one another. Further, the nature of the interference of these waves can depend on the geometry of the components of the system 400, for example, the diameters and thicknesses of the tool casing 412, drill fluid 404, and well casing 410. Due to constraints imposed by various other engineering requirements of the system 400, it can in some cases be difficult to optimize these dimensions to improve or optimize the interference of the transmitted and reflected portions of the initial shock wave.

Thus, in system 400, the shock conditioning shell 414 can be configured to impose additional reflection boundaries (e.g., at an interface between the shell 414 and the HE 406, and at an interface between the shell 414 and the HE 408), which can provide a greater degree of control over the nature of the reflected waves and thus the constructive vs. destructive nature of their interference with each other and with the transmitted waves. Thus, use of the shell 414 can allow improvement or optimization of interference of the shock waves produced by a detonation of the HE 406, 408. Including the shell 414 within the tool casing 412 reduces the amount of HE material that can be stored within the casing 412 (because some of the available space is filled by the shell 414), thus reducing the total explosive potential of the HE material in the tool. Including the shell 414 within the casing 412 thus produces a surprisingly improved system 400: a system 400 that used less HE material 406, 408, yet produces a larger net effect on the geologic formation 402.

With reference to FIG. 5, in some cases, the shock conditioning shell 414 can have a radius which is between about 50% and about 90% of an inside radius of the casing 412. That is, a distance D2 can be between 50% to 90% of a distance D3. In some cases, the shock conditioning shell 414 can have a radius which is between about 75% and about 90% of an inside radius of the casing 412. In some cases, as the strength and/or hardness of the geologic formation 402 increases, the radius of the shell 414 can be increased with respect to an inside radius of the casing 412. In some cases, as the strength and/or hardness of the geologic formation 402 decreases, the radius of the shell 414 can be decreased with respect to an inside radius of the casing 412. In some cases, as the dimension D1 increases, the radius of the shell 414 can be decreased with respect to an inside radius of the casing 412. In some cases, as the dimension D1 decreases, the radius of the shell 414 can be increased with respect to an inside radius of the casing 412.

D. Tape Joints for use with Explosive Fracturing Systems and Methods

FIGS. 6-9 illustrate components of an explosive fracturing tool 500 formed from a series of modular components. Tool 500 includes a first annular outer shell 501 including a main body portion 502 and an outer extension portion 504, and a second annular outer shell 513 including a main body portion 514 and an inner extension portion 516. Tool 500 also includes a first cylindrical HE capsule 534, a cylindrical equipment capsule 538, and a second cylindrical HE capsule 536. The annular shells 501, 513 and the cylindrical capsules 534, 536, 538 can be concentric with one another and have a common central longitudinal axis or centerline 540. The shells 501, 513, and capsules 534, 536, 538 can be modular, such that various capsules can be combined and rearranged in various configurations within a plurality of shells. The shells 501, 513 can comprise aluminum.

While only two shells 501 and 513 are illustrated, three, four, five, or more shells can be used and combined with one another as illustrated in FIGS. 6-9. For example, the second annular outer shell 513 can have an outer extension portion (not illustrated) at an end of the shell 513 opposite the inner extension portion 516. A third annular outer shell (not shown) can include an inner extension portion and can be coupled to the outer extension portion of the second annular outer shell 513 in the manner described herein for coupling the first and second annular outer shells 501, 513 to one another.

The shells 501, 513 can have the same or substantially the same outside diameter such that respective outer surfaces of the shells are flush or substantially flush with one another. Similarly, the shells 501, 513 can have the same or substantially the same inside diameter such that respective inner surfaces of the shells are flush or substantially flush with one another. The outer extension portion 504 and the inner extension portion 516 can have dimensions such the shells 501, 513 can be aligned along a common axis and brought toward one another such that the inner extension portion 516 fits within the outer extension portion 504.

To facilitate coupling of the shells 501, 513 to one another, the outer extension portion 504 can include an annular first sealing channel 506, an annular first locking channel 508, an annular second locking channel 510, and an annular second sealing channel 512, and the inner extension portion 516 can include an annular first sealing channel 518, an annular first locking channel 520, an annular second locking channel 522, and an annular second sealing channel 524. The channels 506, 508, 510, 512, 518, 520, 522, and 524 can be positioned such that when the inner extension portion 516 is seated within the outer extension portion 504, the first sealing channels 506 and 518 are aligned with and adjacent to one another, the first locking channels 508 and 520 are aligned with and adjacent to one another, the second locking channels 510 and 522 are aligned with and adjacent to one another, and the second sealing channels 512 and 524 are aligned with and adjacent to one another.

Figure 6:
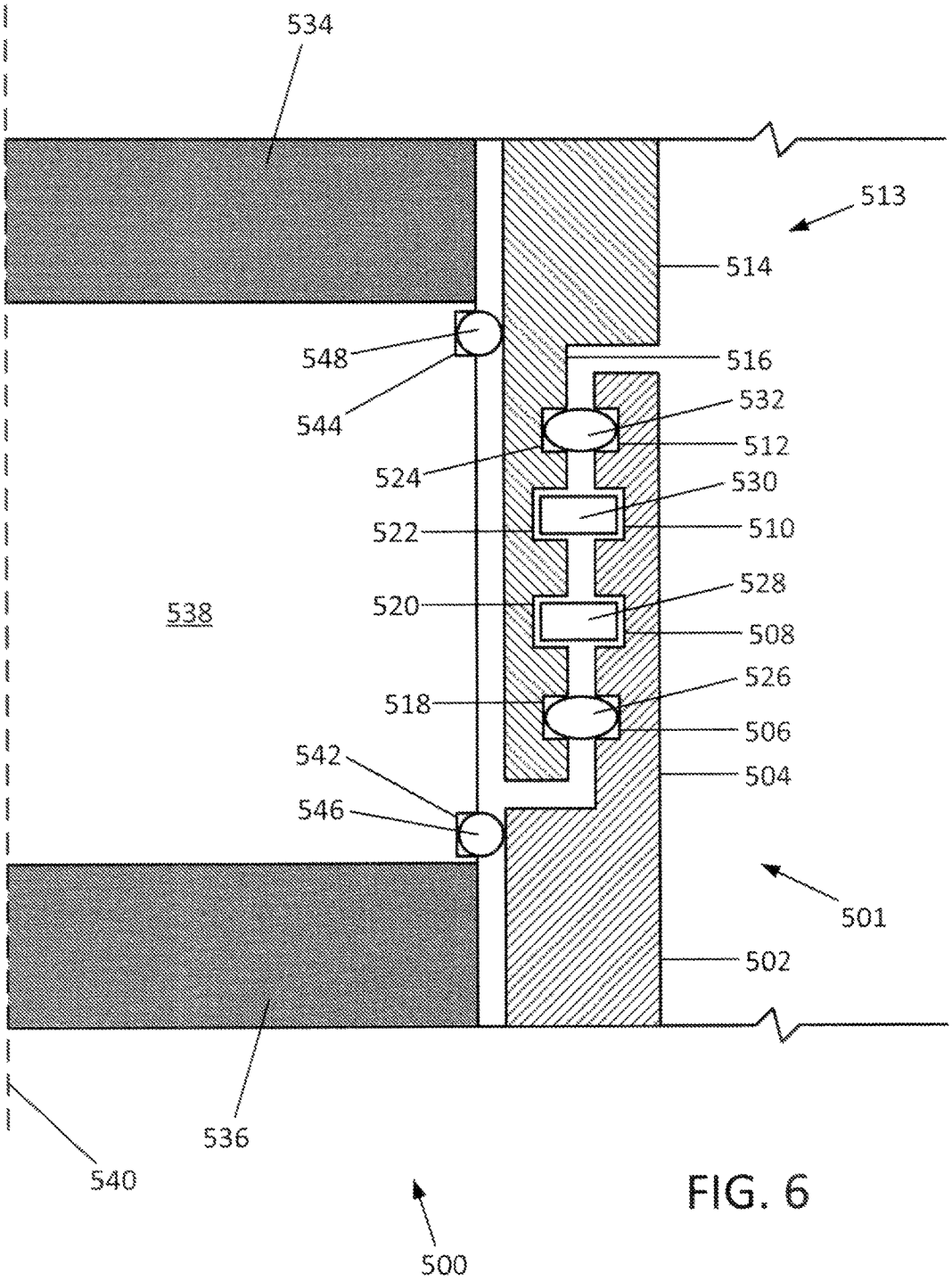
FIG. 6 illustrates an embodiment of an explosive fracturing tool formed from a series of modular components.

To lock the outer extension portion 504 to the inner extension portion 516, and thus lock the shells 501, 513 to one another, a first annular rigid locking tape 528 can be positioned within the first locking channels 508 and 520 and a second annular rigid locking tape 530 can be positioned within the second locking channels 510 and 522. The locking tapes 528 and 530 can have dimensions which are larger than respective dimensions of openings formed by the combination of the channels 508 and 520, or 510 and 522, respectively. Thus, after the shells 501, 513 are aligned along a common axis, brought toward one another, and the tapes 528, 530 are positioned as illustrated in FIG. 6, the shells 501, 513 are prevented from moving along the common axis with respect to one another by the tapes 528, 530.

The shells 501 and 513 can enclose an interior of the tool including the capsules 534, 536, 538, and can separate the interior from an exterior of the tool, such that the tool can be situated in a borehole, e.g., within a drill fluid, without the drill fluid entering the shells and interfering with the operation of the tool 500. To seal the tool 500, a first sealing o-ring 526 can be positioned within the first sealing channels 506 and 518 and a second sealing o-ring 532 can be positioned within the second sealing channels 512 and 524. As illustrated in FIG. 6, the tapes 528, 530 and o-rings 526, 532 can be arranged so that the tapes 528, 530 are positioned between the o-rings 526, 538 along the longitudinal axis 540.

To further seal the tool 500, the equipment capsule 538 can have a third annular sealing channel 542 and a fourth annular sealing channel 544. A third sealing o-ring 546 can be positioned within the third sealing channel 542 and in sealing contact with the interior surface of the shell 501. A fourth sealing o-ring 548 can be positioned within the fourth sealing channel 544 and in sealing contact with the interior surface of the shell 513. The first, second, third, and fourth sealing o-rings can comprise any suitable materials, such as various synthetic or natural rubbers, plastics, thermoplastics, elastomers, etc.

Figure 7:
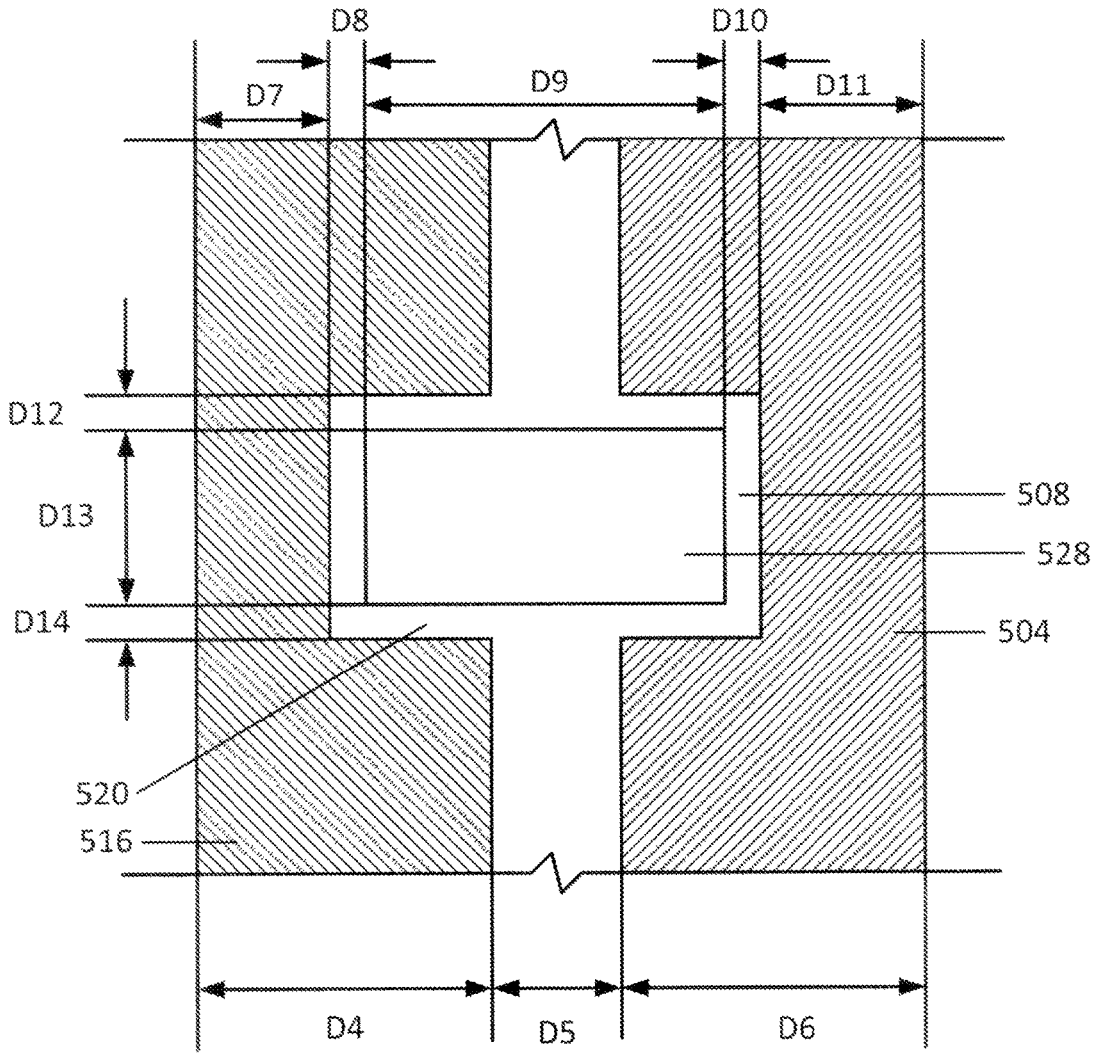
FIG. 7 illustrates an embodiment of a tape joint.

FIG. 7 (not to scale) illustrates exemplary dimensions of the first locking tape 528 and the first locking channels 508 and 520. For example, D4 can be 0.24", D5 can be 0.02", D6 can be 0.24", D7 can be 0.14", D8 can be 0.01", D9 can be 0.2", D10 can be 0.01", D11 can be can be 0.14", D12 can be 0.005", D13 can be 0.24", and D14 can be 0.005". In such an embodiment, the overall width of the wall of the first and second shells 501, 513 (e.g., the sum of D4, D5, and D6) can be 0.5", the overall width of the channels 508, 520 (e.g., the sum of D12, D13, and D14) can be 0.25", and the overall depths of the channels 508, 520 (e.g., the difference between D6 and D11) can be 0.1 inches. These dimensions are merely examples, and any suitable dimensions can be used.

The second locking tape 530 and the second locking channels 510, 522 can have the same, substantially the same, or different dimensions from those of the tape 528 and the channels 508, 520. The locking tapes 528, 530 can have square, rectangular, or other cross-sectional shapes. In some cases, the tapes 528, 530 can have a circular cross-sectional shape, which can be less expensive and increase the flexibility of the tapes about axis 540. The respective locking channels can have corresponding cross-sectional shapes. The locking tapes 528, 530 can be metallic or can comprise various other materials. In some cases, the locking tapes 528, 530 can comprise steel, titanium, or any material as strong or stronger than the material of the shells 501, 513 (e.g., aluminum). The locking tapes 528, 530 can be substantially rigid in shear, such that when positioned in the channels 508, 510, 520, 522, the first and second shells 501, 513 cannot be separated from one another along the axis 540, while being relatively flexible in bending about the axis 540.

Figure 8:
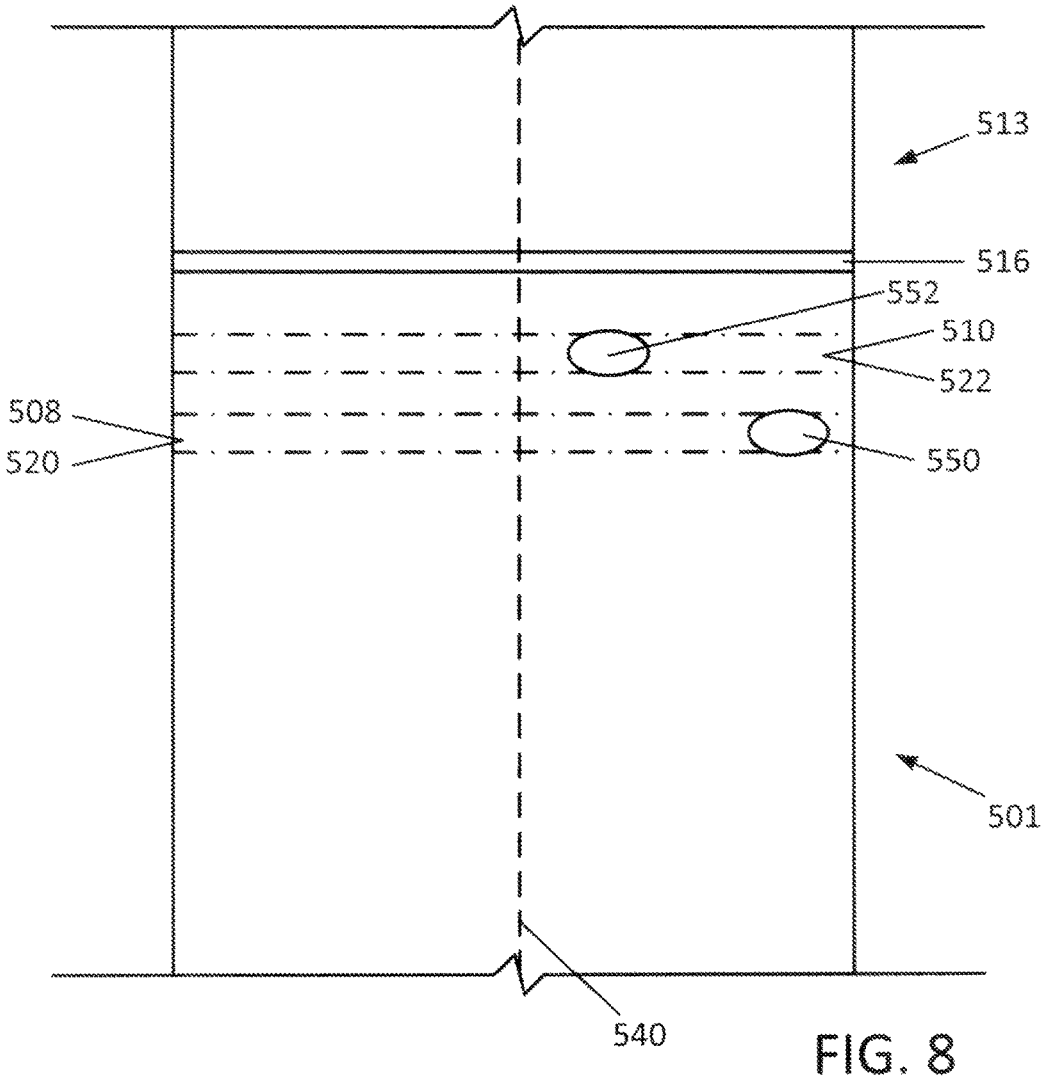
FIG. 8 illustrates an external side view of FIG. 6.

FIG. 8 illustrates an external side view of the first and second shells 501, 513, with a portion of the inner extension portion 516 visible and the first locking channels 508, 520 and second locking channels 510, 522 shown in dashed lines. As shown in FIG. 8, the first shell 501 includes a first opening 550 providing access to the first locking channels 508, 520, and a second opening 552 providing access to the second locking channels 510, 522. In order to position the first and second locking tapes 528, 530 within the respective locking channels, the locking tapes can be inserted through the openings 550, 552 and pushed through the respective channels. In some cases, the locations of the openings 550, 552 can be angularly staggered around the axis in order to improve the consistency of shear strength provided by the tapes 528, 530 about the axis 540. The locking tapes 528, 530 can each have a length sufficient to extend through the respective grooves up to about 360° around axis 340, or up to about 350° around axis 340, or up to about 340° around axis 340, or up to about 330° around the axis 340. In some embodiments, plugs can be provided to plug the openings 550, 552 after the tapes 328, 330 have been inserted through the openings 350, 352, and into the respective grooves. In some embodiments, the plugs can comprise aluminum and can be coupled to the shells 501, 513 with counter-sunk screws.

Figure 9:
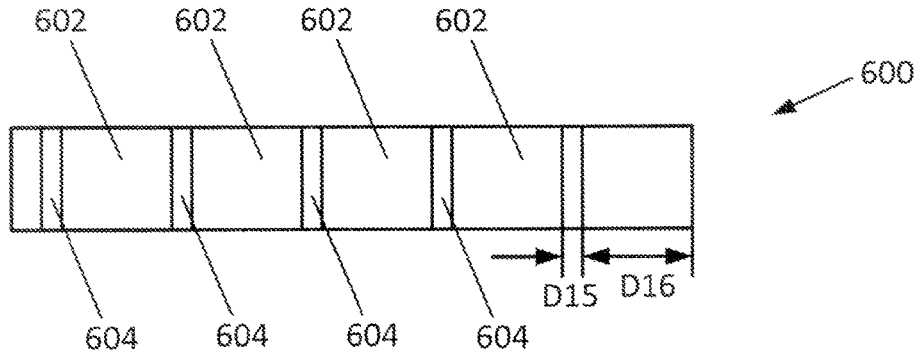
FIG. 9 illustrates an exemplary locking tape.

FIG. 9 illustrates an exemplary locking tape 600 which can be used as locking tape 528 or 530. The locking tape 600 includes alternating locking portions 602 and groove portions 604. The locking portions 602 can have a full thickness, such as a thickness equal to D9 or 0.2", as explained above. The groove portions 604 can have a reduced thickness, such as half the thickness of the locking portions 602, or about one third the thickness of the locking portions 602, or one fourth the thickness of the locking portions 602, or less than a quarter the thickness of the locking portions 602. The groove portions 604 can improve the flexibility of the tape 600 such that the tape 600 can be more easily inserted into one of the openings 550, 552, and bent about the axis 540. In some cases, the locking portions 602 can have a length of about 1", or a length of about 2", or a length of about 1½", or a length between about 1" and 2", and the groove portions can have a smaller length, such as about 1", or about ½", or about ¼", or about ⅛", or smaller than ⅛".

In alternative embodiments, only one set of locking grooves and one locking tape can be used. In other embodiments, three, four, five, six, eight, ten, twelve, or more locking grooves and locking tapes can be used. Use of tape joints as described above can provide a smooth interior surface to the shells 501, 513, and reduce the overall thickness of the shells 501, 513 and the joint holding them together (e.g., to about ½", as described above). By reducing the overall thickness of the shells and their respective joints, the amount of material that can be held within the shells can be increased, providing substantial advantages. The tape joints described herein also provide a stronger, simpler design, in which shear loads are more evenly distributed about the axis 540 than in known designs. For example, there is no need to thread one shell into another to couple them to each other. As another example, the tape joints described herein are advantageous over many known joints, which typically require twice the thickness of the tape joints, thereby reducing the amount of material which can be held within the shells.

E. Spline Systems for use with Explosive Fracturing Systems and Methods

Figure 11:
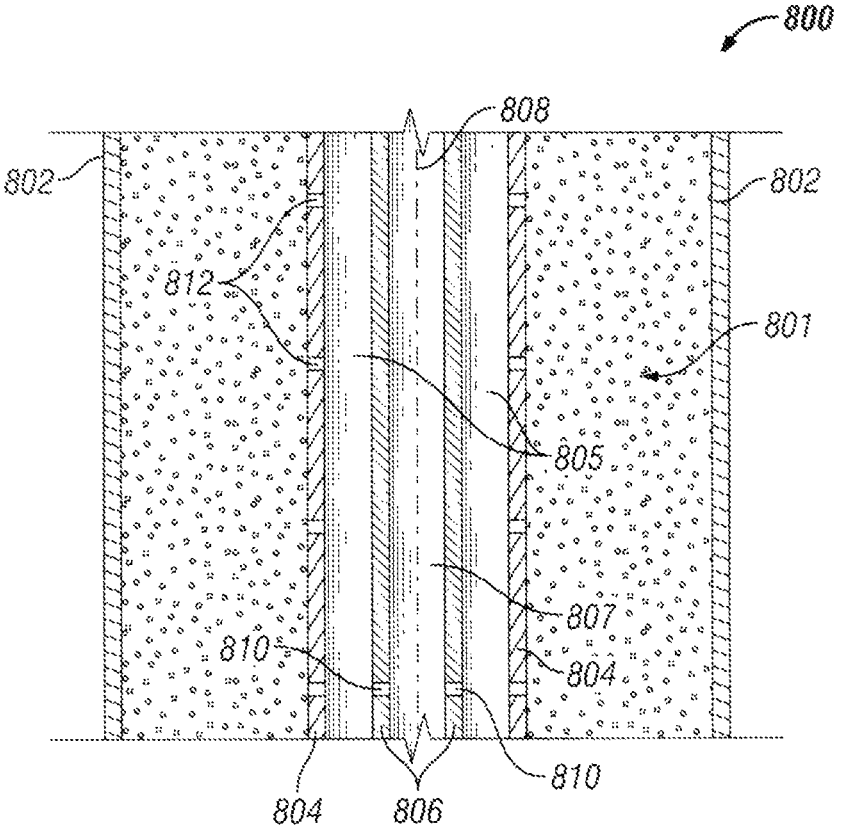
FIG. 11 illustrates a spline system for use in explosive fracturing systems.

FIG. 11 illustrates a spline system 800 for use with explosive fracturing systems and methods. System 800 includes an outer casing, or container, or shell 802, an intermediate shell 804, and a central shell (or spline, or spine) 806. The shells 802, 804, and 806 can be annular, or tubular elements concentrically situated along a central axis 808. A high explosive (or HE) material (or a precursor material) 801 can be situated between the shell 802 and the shell 804. An escape or vent channel 805 can exist between the shell 804 and the shell 806, and a fill channel 807 can exist within the shell 806. The shell 806 can have openings 810 located at a distal end portion of the shell 806, which can couple the fill channel 807 to the escape channel 805. The shell 804 can have openings 812 located along the length of the shell 804 (e.g., it can be perforated along its length), which can couple the escape channel 805 to the HE or precursor material 801.

In use, a liquid such as a liquid fuel can be fed through the fill channel 807 to the distal end portion of the shell 806, where it can travel through the openings 810 into the escape channel 805. As the liquid is continued be fed through the fill channel 807, the liquid can fill the escape channel 805 until it reaches a first set of the openings 812, at which point the fluid can migrate through the openings 812 into the HE or precursor material 801. As the fluid migrates into the HE or precursor material 801, any excess or trapped gases displaced therefrom can migrate back through the openings 812 into the escape channel 805. As the liquid is continued to be fed through the fill channel 807, the liquid can migrate proximally through the escape channel 805 and through additional sets of the openings 812. When the liquid has saturated the HE or precursor material 801, any excess liquid can also continue to flow proximally through the escape channel 805.

System 800 allows efficient, rapid, and complete filling of the HE or precursor material with a liquid such as a fuel.

Figure 12A:
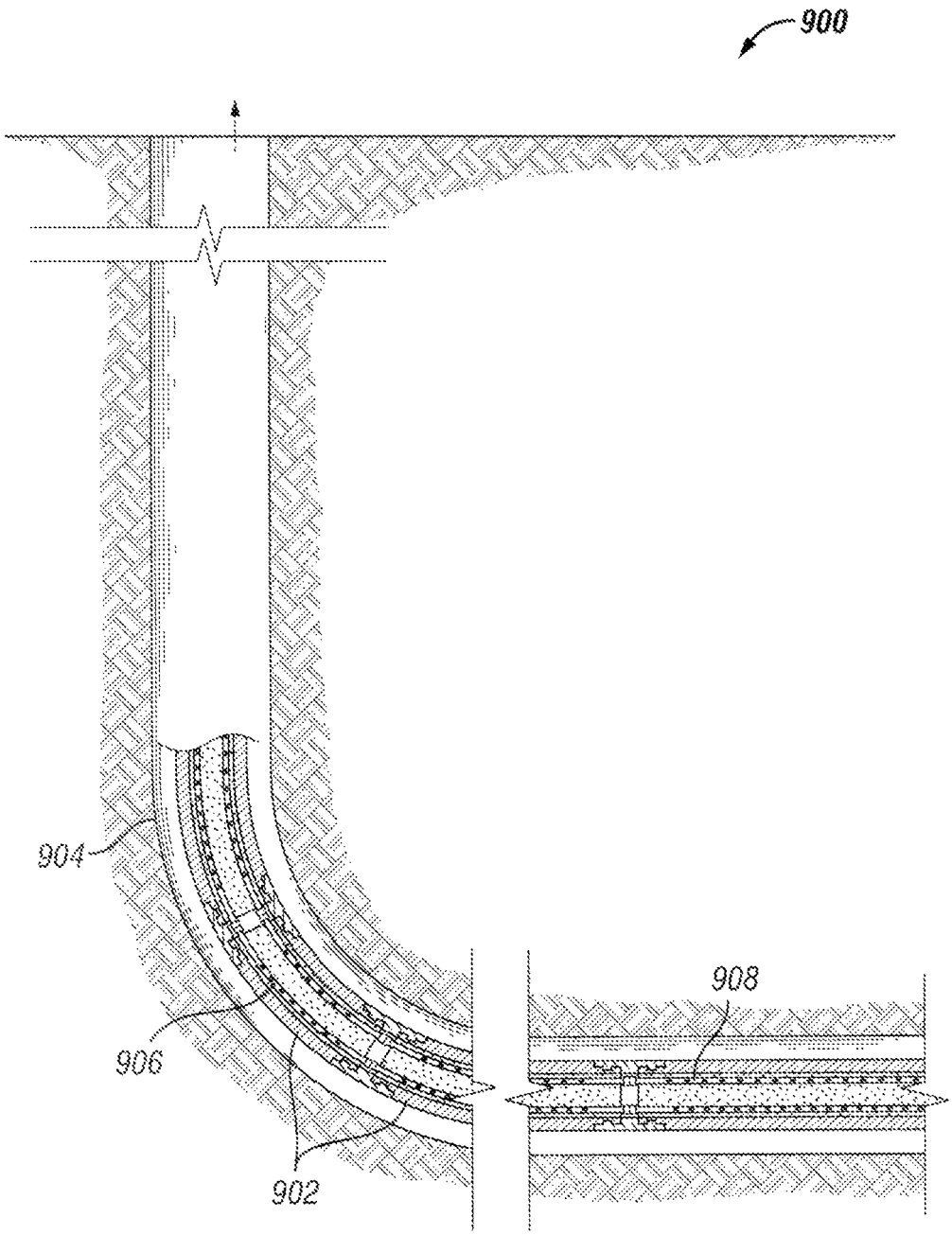
FIG. 12A illustrates a venting system for use in explosive fracturing systems.
Figure 12B:
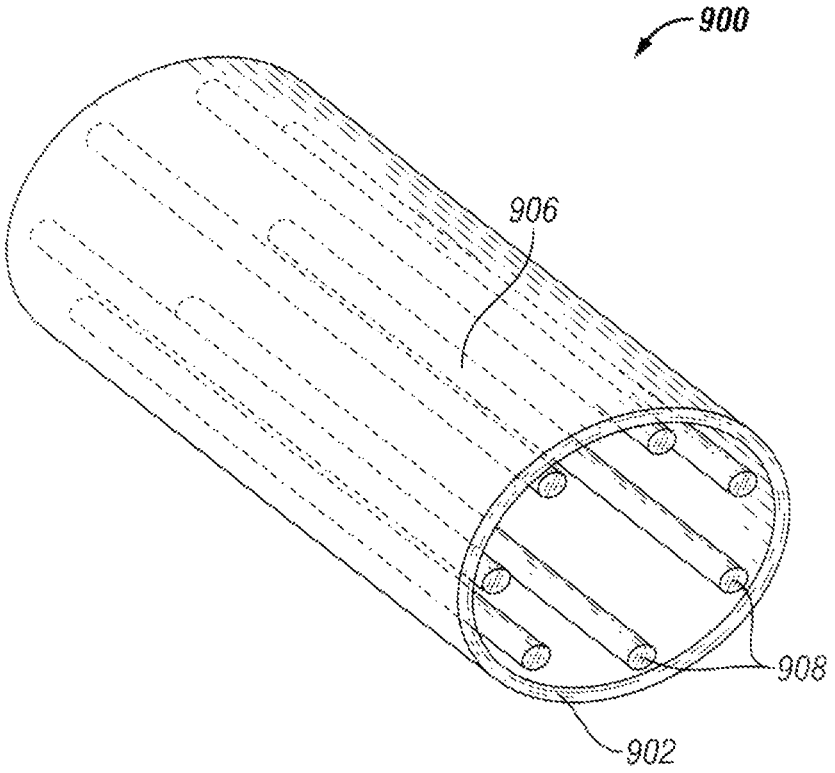
FIG. 12B illustrates a second embodiment of a venting system for use in explosive fracturing systems.

FIGS. 12A-B show an alternative system 900 for use with explosive fracturing systems and methods. System 900 is similar to system 800, but includes multiple containers 902 situated within a borehole 904, and includes a fill pipe 906 and multiple internal perforated vent, or escape pipes 908. System 900 is also different from system 800 in that the liquid flow paths between the fill pipe 906 and the escape pipes 908 pass through the HE or precursor material. Such an embodiment may be better suited to applications in which the pipes 906, 908 are horizontal, rather than vertical, as it can ensure that a liquid fuel more fully saturates the HE or precursor. In system 900, one fill pipe can feed each of the containers 902, and each of the escape pipes 908 can be coupled to each of the containers 902.

In some cases, the intermediate shell 804 and/or central shell 806 can be a shock conditioning shell, as described elsewhere herein.

Figure 13:
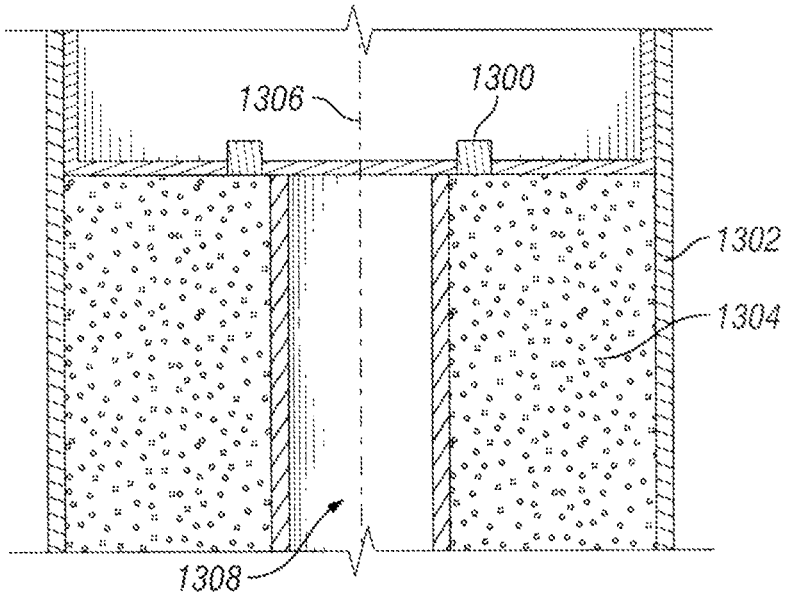
FIG. 13 illustrates a side view of a ring detonation system.
Figure 14:
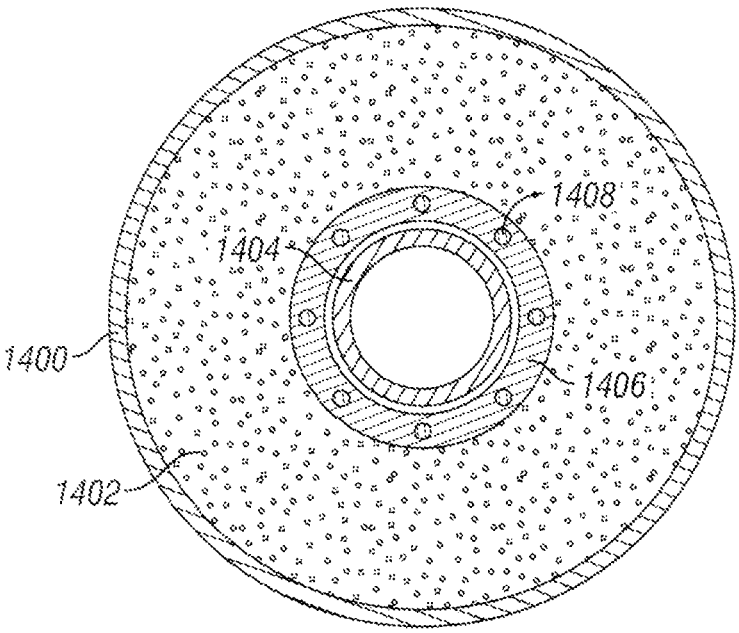
FIG. 14 illustrates an end view of a ring detonation system.

F. Ring Detonation Systems for use with Explosive Fracturing Systems and Methods In some cases, a detonation device can be situated along a central longitudinal axis of a container to produce a virtually uniform detonation wave. In other embodiments, such as some embodiments including a central spline as described elsewhere herein, a ring detonator can be used to produce a virtually uniform detonation wave. For example, FIGS. 13 and 14 illustrate side and end views, respectively, of a ring detonation system including a ring detonator at one end of a container and surrounding a central spline of the container. In FIG. 13, HE 1304 or precursor material is located between the case 1302 and a central cavity 1308. The detonation system ring 1300 is located a distance away from a centerline 1306 such that the detonation of the detonation system ring produces a uniform detonation wave. In some cases, the ring detonator can be relatively narrow, as shown in FIGS. 13 and 14, while in other embodiments, the ring detonator can be wider, and can substantially cover the entire end surface of the container. In some cases, such as that shown in FIG. 14, the ring detonator 1406 contained within the case 1400 can include and use exploding bridge wires or exploding foil initiators 1408 positioned in a ring around the spline 1404 to the inside of the HE or precursor material 1402, which can be detonated simultaneously. In some cases, such a system can use 8 initiation points, but in various embodiments can have between 2 and 48 initiation points, or even more if desired.

Figure 15:
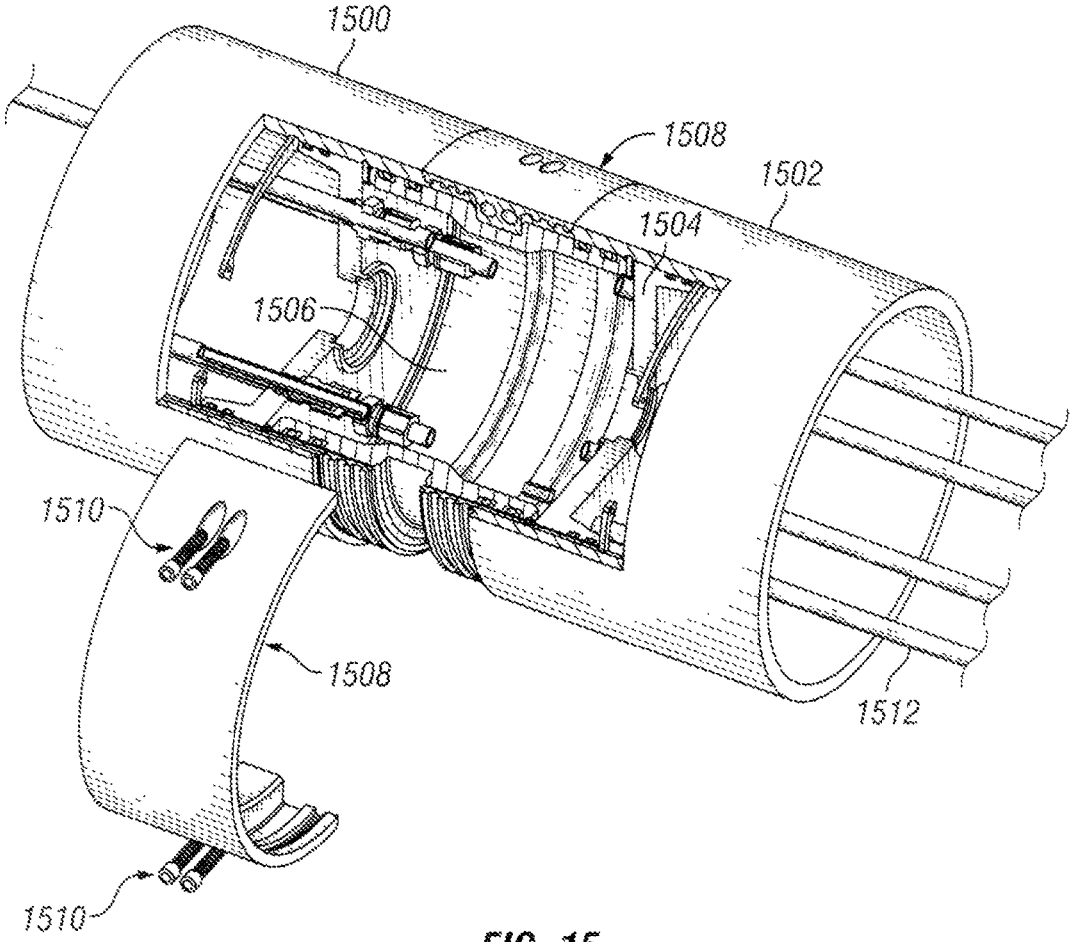
FIG. 15 illustrates an embodiment of a container coupled to a second container through the use of a split clamp.
Figure 16:
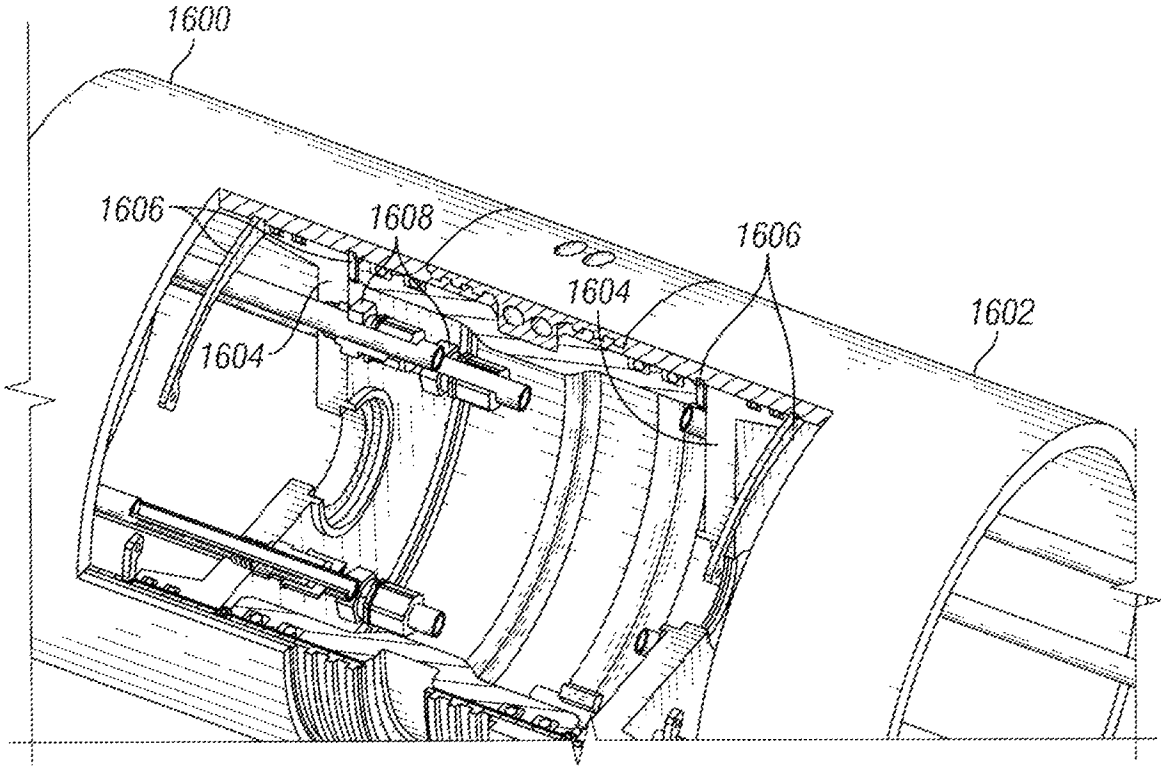
FIG. 16 is a cut out view of the split clamp of FIG. 15.
Figure 17:
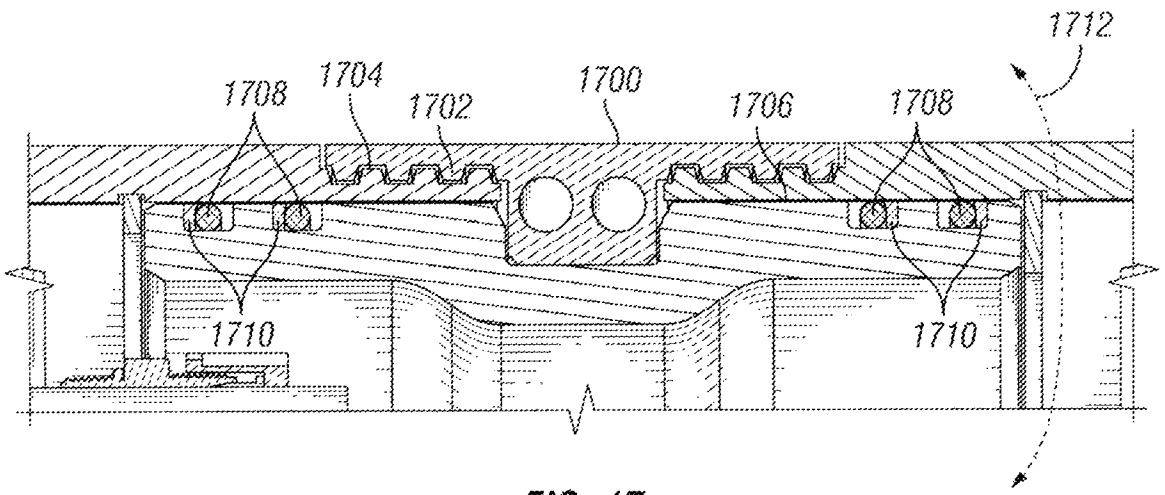
FIG. 17 illustrates an embodiment of a sealing mechanism using a split clamp.

G. Split-Clamp Container Coupling for use with Explosive Fracturing Systems and Methods FIGS. 15-17 illustrate a split-clamp container coupling for use with explosive fracturing systems and methods.

Explosive fracturing tools can be made of segmented containers. Said containers can be coupled together into a string before insertion into a borehole or while the string is piecewise being inserted into the hole. Piecewise assembly of segments and/or short strings of segments (likely up to at least 50 feet (15.24 meters) long) enables existing cranes and work-over rigs to handle the insertion and assembly.

Boreholes are frequently non-straight, and often curve underground to intercept a desired geologic zone which is often a horizontal stratum. A segmented string that can bend to follow the borehole is therefore advantageous. This bending can be accomplished at the joints between each adjacent pair of coupled containers. A coupling mechanism which can allow for adjacent container pair misalignment is therefore advantageous. With misalignment allowed by the coupler geometry, a seal against the leakage of stemming fluids, gases, and other fluids is advantageous.

One or more tape joints can be used to join adjacent segments. This has the advantage of minimizing the non-explosive gap length between segments.

Alternatively, as illustrated in FIGS. 15-17, split claps can be applied and removed. A split clamp with a plurality of annular radially inward facing tooth features, can be used to engage a plurality of anular, radially outward facing teeth in the outside end of a tool container segment. The split clamp can be engaged and kept closed on the tube ends by a fastening means such as screws to draw the clamp segments together.

FIG. 15 illustrates an embodiment of a container 1500 coupled to an adjoining container 1502 through the use of a split clamp 1508. Each container comprises end caps 1504 which allows passage of tubular members 1512. Between the containers is an internal sealing spool 1506. In an embodiment, the split clamp is held to the containers through the use of split clamp fastening screws 1510.

FIG. 16 is a cut out view of the split clamp system between container 1600 and adjoining container 1602. With the advantage of grooved tube ends and machined internal bore surfaces, end caps 1604 can be used to seal the tube ends using o-ring technology and the chemical compatibilities of the end cap 1604 and o-ring materials can be taken into account. These end caps 1604 can be held in place with snap-rings 1606 engaging corresponding grooves in the tube bores. The snap rings 1606 can prevent axial movement of the end caps 1604 in the tubular container bores due to pressure differential and gravitational loading of the contents of tubes standing with their axis substantially vertical. The tube end caps 1604 can be equipped with sealed feed-through means 1608 allowing the passage of a plurality of tubular members which can be used to contain cables feeding through the tool container segments as well as liquids and gases for venting.

FIG. 17 is an embodiment of a sealing mechanism using a split clamp 1700 with a plurality of engaging tooth features 1702 between two containers. The sealing of the tool container segments can be accomplished by the use on an internal spool member with a plurality of grooves to accept sealing rings which seal on the smooth, inner bore of the tool container ends. In order to allow for the angular misalignment 1712 allowed by the tooth clearance 1704, a corresponding internal seal spool bore gap can also be provided. This radial clearance 1706 between the outside diameter of the spool and the inside bore of the tool container end bores can be similar in size to the tooth gap clearance 1704 to allow for misalignment 1712. O-rings 1708 and backing rings 1710 may be used to seal the system. With a bore gap of 0.015 inches (0.381 mm) or more on each side of the spool, the seals (e.g., O-Ring or Quad-Ring seals) can extrude into the gap if sufficient differential pressure exists between the inside and outside of the tool. Therefore, a higher stiffness and strength material can then be inserted into the grooves in the spool which can be more resistant to the extrusion-inducing pressure differential. A substantial clearance gap 1704 between mating teeth of the clamp tube interface of 0.015 inches (0.381 mm) or greater can be provided.

H. Other Containers and Detonators

In some embodiments, the container comprising a precursor component (or composition there), or a mixed precursor composition, can comprise a tubular casing, an end cap, and a detonator. The casing can comprise a first longitudinal end portion, a second longitudinal end portion, and an internal chamber configured to contain a precursor component (or composition there), or a mixed precursor composition. The first longitudinal end portion can comprise first external threads having a first thread orientation, and the second longitudinal end portion can comprise second external threads having a second thread orientation that is opposite of the first thread orientation. The end cap can be secured to the first longitudinal end portion of the casing and can comprise a central longitudinal opening and at least one gland configured to sealingly receive a wire passing through the end cap. In some embodiments, the detonator can extend through the central longitudinal opening in the end cap and can have a first portion extending into the internal chamber and configured to be held in contact with precursor component (or composition there), or a mixed precursor composition, to which a liquid fuel is to be added, and a second portion configured to be electrically coupled to a detonation controller.

In some embodiments, explosive charges can be positioned in a spaced apart relationship to create a coalescing shock wave front extending radially outwardly from the bore hole at a location between the explosive charges to enhance the impact of the explosive composition on the surrounding environment.

In some embodiments, one or more container embodiments disclosed herein can be mechanically or electrically coupled in a string and can comprise a pair of adjacent containers comprising a precursor component (or composition thereof), a mixed precursor composition, an explosive composition, or any combination thereof and further comprising a connector that comprises a detonator control module configured to control detonation of the adjacent containers of the system. In some embodiments, one or more containers can comprise a single container and an adjacent connector that comprises a detonator control module configured to control detonation of only that single container.

Each container can be independently detonated. Each container can comprise one or more detonators or initiators. The one or more detonators can be located anywhere in the container, such as at one or both axial ends of the container or intermediate the axial ends. In some embodiments, one or more of the containers can be configured to be detonated from one axial end of the container with a single detonator at only one axial end of the container that is electrically coupled to the detonator control module in an adjacent connector.

In some embodiments, the container can be configured to be detonated or ignited from both axial ends of the container at the same time, or nearly the same time. For example, a container embodiment comprising a precursor component (or composition thereof), or a mixed precursor composition, can comprise two detonators/igniters/initiators, one at each end of the container. Each of the detonators of the container can be electrically coupled to a respective detonator control module in the adjacent connector. Thus, in some embodiments, one or more system embodiments configured in a string can comprise a pair of adjacent containers and three adjacent connectors. The three adjacent connectors can comprise an intermediate connector that comprises a detonator control module that is electrically coupled to and controls two detonators, one of each of the two adjacent containers. The two connectors at either end of the system can each comprise a detonator control module that is electrically coupled to and controls only one detonator at that end of the system. In system embodiments having three or more containers comprising a precursor component (or composition thereof), or mixed precursor composition, each of the intermediate connectors can comprise detonator control modules that control two detonators. In system embodiments having only a single container, the system can comprise two connectors, one at each end of the container. In embodiments having detonators intermediate to the two axial ends of the container, the detonator can be coupled to a detonation control module coupled to either axial end of the container, with wires passing through the material and end caps to reach the detonation control module.

In some embodiments, a shock transfer device can be used to ignite or detonate an explosive composition present in the container after the liquid fuel has been added.

In some embodiments, a high-speed shock wave can be used to ignite or detonate the explosive composition.

In some embodiments, the detonation system can be one that produces a symmetric detonation, thereby mimicking a single detonator. Such embodiments can be used in combination with a multi-phase explosive tool embodiment disclosed herein. As a single detonator may or may not be used with particular embodiments, such as those comprising a spine system, these detonation system embodiments can be used to achieve desired detonation results. In some embodiments, the detonation system can comprise a plurality of exploding bridge wires and/or exploding foil initiators. Either one of these components, or a combination of such components, can be positioned in a ring formation around a spine system. Simultaneous detonation of the exploding bridge wires and/or the exploding foil initiators can thereby mimic a single detonation point. In some embodiments, a plurality of initiation points can be used, such as 2 initiation points to 48 initiation points, or 2 initiation points to 20 initiation points, or 2 initiation points to 8 initiation points.

In some embodiments, a plane-wave lens can be used to obtain detonation of a detonator that is separated from the explosive composition. Such embodiments could allow for implementation of a detonator within the container that can be shipped or transported safely to a site where the container will be placed under ground. In some embodiments, the liquid fuel can be added to the container which comprises an air gap that separates the lens from the precursor component or mixed precursor composition. Once the liquid fuel fills the lens, plane wave detonation can occur. Containers can be modified to include a plane-wave lens detonator. For example, a container can be configured as discussed in J. N. Fritz, "A Simple Plane-Wave Explosive Lens," the relevant portion of which is incorporated herein by reference.

V. Exemplary Embodiments

General procedure: Batches of 500 g, or smaller, were prepared by hand by first blending the oxidizer component and the metal component together followed by addition of the liquid fuel with stirring. After loading the final explosive composition into a copper cylinder and proper boosting the detonation velocity and asymptotic wall velocity were determined. The wall velocity was then used to determine a Gurney energy and/or JWL equation of state.

Measurements: To interrogate the interplay between prompt chemical reactions and Al combustion in the temporal reactive structure, various measurement techniques can be applied. Predictions of the heats of reaction and detonation characteristics using modern thermochemical codes are used to guide the formulations and comparisons of theoretical values versus measured can give accurate estimations of the kinetics of the metal reactions. From measurement of the acceleration profile of metals with the explosives product gases, the pressure-volume relationship on an isentrope can be fit and is represented in the general form in equation 1, represented as a sum of functions over a range of pressures, one form being the JWL, equation 2.

$$P_S=\Sigma\phi i(v) \quad \text{(eq 1)}$$

$$P_S=Ae^{-R_1V}+Be^{-R_2V}+CV^{-(\omega+1)} \quad \text{(eq 2)}$$

In the JWL EOS, the terms A, B, C, $R_1$, $R_2$ and w are all constants that are calibrated, and $V=v/v_o$ (which is modeled using hydrocodes). With thermochemically predicted EOS parameters, and the calibrated EOS from tested measurements, both the extent and the timing of metal reactions is accurately be accessed, and utilized for both optimization of formulations as well as in munitions design. The time-scale of this indirect observation of metal reactions dramatically exceeds what is possible from that of direct measurements, such as spectroscopic techniques. The formulations are then optimized by varying the amount, type and particle sizes of metals to both enhance the reaction kinetics, as well as tailor the time regime of energy output. Traditional or miniature versions of cylinder expansion tests can be applied to test down selected formulations. Coupled with novel blast measurement techniques, such testing can provide a quantitative, thorough understanding of metal reactions in the explosive compositions disclosed herein provide combined effects with a number of potential applications.

Formulation:

Chemical formulations can be developed to optimize for cylinder energy. Such formulations can be developed to provide different chemical environments as well as variation in temperature and pressure. To verify thermoequlibrium calculations at a theoretical state or zero Al reaction, an inert surrogate for Al can be identified. Lithium fluoride (LiF) is one such material that may be substituted in certain formulations as an inert surrogate for Al. The density of LiF is a very close density match for Al (2.64 $gcm^{-3}$ for LiF vs 2.70 $gcm^{-3}$ for Al), the molecular weight, 25.94 $gmol^{-1}$, is very close to that of Al, 26.98 $gmol^{-1}$, and it has a very low heat of formation so that it can be considered inert even in extreme circumstances. Because of these properties, LiF is believed to give formulations with near identical densities, particle size distributions, product gas molecular weights and yet give inert character in the EOS measurements. Initial formulations can be produced with 50% and 100% LiF replacing Al. An understanding of reaction rates in these environments are used to develop models for metal reactions that extend beyond the current temperature and pressures in existing models.

The following numbered paragraphs (1 to 111) define particular embodiments of the present invention:

1. A method for making an explosive composition, comprising:

placing a composition comprising an oxidizer below ground;

placing a composition comprising a metal component below ground;

mixing the composition comprising the oxidizer with the composition comprising the metal component to form a mixed precursor composition; and adding to the mixed precursor composition a composition comprising a liquid fuel selected from nitromethane or hydrazine to form the explosive composition, wherein the liquid fuel composition does not comprise a nitroazole compound.

2. The method of claim 1, wherein the composition comprising the oxidizer is placed below ground before or after the composition comprising the metal component.

3. The method of claim 1, wherein the composition comprising the oxidizer is placed below ground at substantially the same time as the composition comprising the metal component.

4. The method of any one of claims 1-3, wherein the oxidizer comprises an anionic component and a cationic component.

5. The method of claim 4, wherein the anionic component is selected from perchlorate, chlorate, nitrate, dinitramide, nitroformate, or any combination thereof.

6. The method of claim 4, wherein the cationic component is selected from ammonium, methylammonium, hydrazinium, guanidinium, amino guanidinium, diaminoguanidinium, triaminoguanidinium, Li, Na, K, Rb, Cs, Mg, Ca, Sr, Ba, Be, or any combination thereof.

7. The method of any one of claims 1-6, wherein the oxidizer is selected from ammonium nitrate, ammonium perchlorate, hydrazinium nitrate, or combinations thereof.

8. The method of any one of claims 1-7, wherein the oxidizer is present in an amount ranging from 40 wt % to 80 wt % of the total weight of the explosive composition.

9. The method of any one of claims 1-7, wherein the oxidizer is present in an amount ranging from 45 wt % to 73 wt % of the total weight of the explosive composition.

10. The method of any one of claims 1-9, wherein the oxidizer has a particle size ranging from 1 μm to 1000 μm.

11. The method of any one of claims 1-9, wherein the oxidizer has a particle size ranging from 16 μm to 130 μm.

12. The method of any one of claims 1-11, wherein the metal component is selected from Al, Mg, Ti, Si, B, Ta, Zr, Hf, Fe, Sn, Ni, or combinations thereof.

13. The method of any one of claims 1-12, wherein the metal component is Al.

14. The method of any one of claims 1-13, wherein the metal component is present in an amount ranging from 10 wt % to 30 wt % of the total weight of the explosive composition.

15. The method of any one of claims 1-13, wherein the metal component is present in an amount ranging from 15 wt % to 20 wt %.

16. The method of any one of claims 1-15, wherein the metal component has a particle size ranging from 1 μm to 50 μm.

17. The method of any one of claims 1-16, wherein the composition comprising the oxidizer and the composition comprising the metal component are placed at least 6 feet to 10,000 feet below ground.

18. The method of any one of claims 1-17, wherein the mixed precursor composition comprises a ratio of the oxidizer to the metal component ranging from 49:51 (oxidizer: metal component) to 89:11 (oxidizer:metal component).

19. The method of any one of claims 1-18, wherein the mixed precursor composition comprises a 69:31 ratio of the oxidizer to the metal component.

20. A method for making an explosive composition, comprising:

combining 40 wt % to 80 wt % ammonium perchlorate, ammonium nitrate, or hydrazinium mononitrate with 10 wt % to 30 wt % aluminum to form a non-explosive composition;

placing the non-explosive composition below ground; and adding a composition comprising nitromethane or hydrazine to the non-explosive composition to form the explosive composition.

21. A method for making an explosive composition, comprising: placing 45 wt % ammonium nitrate or 45 wt % ammonium perchlorate below ground;

placing 20 wt % aluminum below ground and combining the aluminum with the ammonium nitrate or the ammonium perchlorate; and adding nitromethane to the aluminum and the ammonium nitrate or the aluminum and the ammonium perchlorate.

22. A method for making an explosive composition, comprising:

placing 73 wt % hydrazinium mononitrate below ground;

placing 20 wt % aluminum below ground and combining the aluminum with the hydrazinium nitrate; and adding 7 wt % hydrazine to the aluminum and the hydrazinium mononitrate.

23. An explosive composition, comprising:

20 wt % to 80 wt % based on a total weight of the explosive composition of an oxidizer component, or a composition thereof;

at least 20 wt % based on a total weight of the explosive composition of a metal component, or a composition thereof; and 5 wt % to 50 wt % based on a total weight of the explosive composition of a synthetic liquid fuel.

24. The explosive composition of claim 23, wherein the oxidizer is ammonium nitrate, ammonium perchlorate, or hydrazinium nitrate.

25. The explosive composition of claim 23 or claim 24, wherein the oxidizer is ammonium nitrate or the ammonium perchlorate and the amount of the ammonium nitrate or the ammonium perchlorate is 45 wt % based on the total weight of the explosive composition.

26. The explosive composition of claim 23 or claim 24, wherein the oxidizer is hydrazinium mononitrate and the amount of the hydrazinium mononitrate is 73 wt % based on the total weight of the explosive composition.

27. The explosive composition of any one of claims 23-26, wherein the metal component is aluminum.

28. The explosive composition of any one of claims 23-27, wherein the synthetic fuel is nitromethane or hydrazine.

29. The explosive composition of any one of claims 23-28, wherein the synthetic fuel is nitromethane and the amount of the nitromethane is 35 wt %.

30. The explosive composition of any one of claims 23-28, wherein the synthetic fuel is hydrazine and the amount of the hydrazine is 7 wt %.

31. A combination, comprising:

an oxidizer component, a metal component, or a combination thereof; and a container housing the oxidizer component, the metal component, or combination thereof.

32. The combination of claim 31, further comprising a detonator.

33. The combination of claim 31, further comprising a liquid fuel.

34. A method for fracturing rock in an underground reservoir comprising:

receiving a precursor composition;

receiving a liquid fuel;

mixing the precursor composition with the fuel in the underground reservoir to form an explosive composition; and detonating the explosive composition in the underground reservoir, thereby fracturing the rock.

35. The method of claim 34, wherein the precursor composition comprises an oxidizer, a metal, or a combination thereof.

36. The method of claim 35, wherein the oxidizer comprises perchlorate, chlorate, nitrate, dinitramide, nitroformate, ammonium, hydroxylammonium, methylammonium, hydrazinium, guanidinium, amino guanidinium, diaminoguanidinium, triaminoguanidinium, an ion of a Group 1 element of the periodic table, an ion of a Group 2 element of the periodic table, ammonium nitrate, ammonium perchlorate, hydrazinium nitrate, or combinations thereof.

37. The method of claim 35-36, wherein the oxidizer is a crystalline solid, a polycrystalline solid, or an amorphous solid.

38. The method of claim 37, wherein the particle size of the oxidizer can range from 1 μm to 1000 μm.

39. The method of claim 35, wherein the metal has a value of 1-2.5 on the Pauling scale.

40. The method of any one of claims 35-39, wherein the metal component comprises a metal selected from any one of Groups 2, 4, 5, 8, 10, 13, or 14 of the periodic table of elements.

41. The method of any one of claims 35-39, wherein the metal is Al, Mg, Ti, Si, B, Ta, Zr, Hf, Fe, Sn, Ni, or combinations thereof.

42. The method of any one of claims 35-41, wherein the metal is a crystalline solid, a polycrystalline solid, or an amorphous solid.

43. The method of claim 42, wherein the metal has particle sizes ranging from 1 μm to 50 μm.

44. The method of any one of claims 34-43, wherein the explosive composition comprises an energy density once detonated from 4 kJ/cc to 17 kJ/cc.

45. The method of any one of claims 34-44, wherein the mixing occurs at a distance of 6 feet to 10,000 feet below ground surface.

46. The method of any one of claims 34-45, wherein the precursor is a lower hazard class than a 1.1 Explosive hazard class as set forth by the United States Department of Transportation.

47. The method of any one of claims 34-46, wherein the precursor comprises both an oxidizer and a metal.

48. The method of claim 47, wherein the ratio of oxidizer to metal ranges from 49:51 to 89:11.

49. The method of any one of claims 35-48, wherein the amount of the oxidizer ranges from 20 wt % to 80 wt % based on the total weight of an explosive composition.

50. The method of any one of claims 35-49, wherein the amount of the metal component ranges from 10 wt % to 30 wt %.

51. The method of any one of claims 34-50, wherein the precursor composition comprises a mixed precursor composition comprising a first precursor composition and a second precursor composition.

52. The method of claim 51, wherein the mixed precursor composition comprises ammonium perchlorate ($NH_4ClO_4$) and aluminum (Al), ammonium nitrate ($NH_4NO_3$) and aluminum (Al), hydrazinium mononitrate ($H_2N—NH_3NO_3$) and aluminum (Al), or ammonium perchlorate ($NH_4ClO_4$) and lithium fluoride (LiF).

53. The method of any one of claims 34-52, wherein the liquid fuel is a synthetic liquid fuel.

54. The method of claim 53, wherein the synthetic liquid fuel component is a nitrated alkane, anhydrous or hydrated hydrazine, ammonia, hydroxylamine, or mixtures thereof.

55. The method of claim 53, wherein the synthetic liquid fuel is nitromethane, hydrazine or a mixture thereof, and does not comprise a nitroazole compound.

56. The method of claim 53, wherein the synthetic liquid fuel is nitromethane, nitroethane, nitrobutane, nitropropane, hydrazine, methyl hydrazine, dimethyl hydrazine, or a mixture thereof.

57. The method of any one of claims 34-56, wherein the liquid fuel is provided in an amount ranging from 5 wt % to 50 wt % of the explosive composition.

58. The method of any one of claims 34-57, wherein the liquid fuel additionally comprises an energetic material, an organic solvent, a dispersant, a surfactant, or combinations thereof.

59. The method of claim 58, wherein the energetic material is nitro-containing hydrocarbons, glycol-containing nitrates, nitroalkenes, nitroalkynes, nitroamines nitroalkyls, nitro-containing aryls, nitro-containing heteroaryls, nitric acids, tetrazines, hydrazines, or combinations thereof.

60. The method of claim 58, wherein the energetic material is nitroethane FOX-7, ethylene glycoldinitrate (EGDN), NG, ETN, PETN, GAP, RDX, HMX, CL-20, TNT, DNT, NB, HNS, NTO, TATB, LAX-112, or combinations thereof.

61. The method of claim 58, wherein the organic solvent is an ether, alcohol, acetone, or combination thereof.

62. The method of claim 58, wherein the organic solvent is di-t-butyl ether, diethyl ether, diethylene glycol diethyl ether, diglyme, diisopropyl ether, dimethoxyethane, dioxanes, methanol, ethanol, isopropanol, or combinations thereof.

63. The method of claim 58, wherein dispersant comprises an anionic surfactant, zwitterionic surfactants, nonionic surfactants, and combinations thereof, and one or more solvents.

64. The method of claim 58, wherein the surfactant is ammonium lauryl sulfate, sodium lauryl sulfate, sodium laureth sulfate, dioctyl sodium sulfosuccinate, perfluorooctanesulfonate, perfluorobutanesulfonate, sodium stearate, perfluorononoate, perfluorooctanoate, 3-[(3-Cholamidopropyl)dimethylammonio]-1-propanesulfonate, octaethylene glycol monododecyl ether, pentaethylene glycol monododecyl ether, decyl gludoside, lauryl glucoside, octyl glucoside, triton X-100, nonoxynol-9, glyceryl laurate, polysorbate, or combinations thereof.

65. The method of any one of claims 34-64, wherein the detonated explosive composition produces a gas in an amount ranging from 10 g per kg of explosive to 200 g per kg of explosive.

66. The method of claim 65, wherein the gas is HCl gas.

67. The method of any one of claims 34-66, wherein a gas is added to the precursor composition, the liquid fuel, or combinations thereof.

68. The method of claim 67, wherein the gas is ammonia.

69. The method of any one of claims 34-68, wherein the precursor composition and/or the liquid fuel are substantially free of air pockets.

70. The method of claim 69, wherein a vacuum is applied to a container comprising the precursor composition, to substantially remove air.

71. A dissolving slidable stop comprising:

an exterior surface formed of a slidable material having a selected dynamic coefficient of friction; and a filler material configured to dissolve at a selected rate when exposed to a liquid such that the liquid is able to traverse the length of the stop once the material is dissolved.

72. The stop of claim 71, wherein the liquid is a fuel.

73. The stop of any one of claims 71-72, wherein the stop is configured to have a size sufficient to seal a selected pipe.

74. The stop of claim 73, wherein the selected dynamic coefficient of friction is selected such that the frictional engagement of the exterior surface of the stop and the interior surface of the pipe resists a selected amount of force while the stop is stationary or moving within the pipe.

75. The stop of any one of claims 71-74, wherein the rate is selected such that the stop dissolves in one minute, two minutes, five minutes, ten minutes, fifteen minutes, twenty minutes, thirty minutes, or one hour when exposed to the liquid.

76. The stop of any one of claims 71-75, wherein the filler material is ABS plastic, Buna N, Fluorocarbon, Neoprene, NORYL, Polycarbonate, Polyurethane, Silicone, Viton, methacrylate plastics, nitrocellulose, polyvinyl alcohol nitrate, polystyrene, or combinations thereof.

77. The stop of any one of claims 71-76, wherein the filler material is the same as the slidable material.

78. The stop of any one of claims 71-76, wherein the filler material is different from the slidable material.

79. A system comprising:

a downhole tool located within a borehole;

a feed pipe extending from an above ground location down the borehole to the tool; and a slidable stop located in the feed pipe, wherein the slidable stop has a size sufficient to block liquid from flowing through the feed pipe, an exterior surface formed of a slidable material having a selected dynamic coefficient of friction, and wherein the slidable stop is situated within the pipe to separate a liquid feed within the feed pipe from the downhole tool.

80. The system of claim 79, wherein the downhole tool is an explosive fracturing tool.

81. The system of any one of claims 79-80, wherein the feed pipe is a fuel feed pipe.

82. The system of any one of claims 79-81, wherein the slidable stop has a diameter larger than the inside diameter of the pipe.

83. The system of any one of claims 79-82, wherein the slidable stop comprises a filler material configured to dissolve at a selected rate when exposed to a liquid such that the liquid is able to traverse the length of the stop once the material is dissolved.

84. The system of claim 83, wherein the rate is selected such that the stop dissolves in one minute, two minutes, five minutes, ten minutes, fifteen minutes, twenty minutes, thirty minutes, or one hour when exposed to the liquid.

85. The stop of any one of claims 83-84, wherein the filler material is ABS plastic, Buna N, Fluorocarbon, Neoprene, NORYL, Polycarbonate, Polyurethane, Silicone, Viton, methacrylate plastics, nitrocellulose, polyvinyl alcohol nitrate, polystyrene, or combinations thereof.

86. The stop of any one of claims 83-85, wherein the filler material is the same as the slidable material.

87. The stop of any one of claims 83-85, wherein the filler material is different from the slidable material.

88. The system of claim 79-87, wherein the system additionally comprises a docking station comprising a slidable stop-storage portion and a coupling portion, wherein the coupling portion is configured to couple the pipe to the tool without allowing the slidable stop into the coupling portion.

89. The system of claim 88, wherein the coupling portion has a width or diameter which is smaller than the length of the slidable stop.

90. The system of claim 79-89, wherein a liquid in the pipe is pressurized behind the slidable stop, thereby sliding the stop down the pipe towards the tool.

91. A cylindrical explosive fracturing tool comprising:

an exterior tool casing;

an internal shock conditioning shell located inside of the external tool casing;

a precursor composition or an explosive composition located in the annulus of the exterior tool casing and the internal shock conditioning shell; and a second precursor composition or a second explosive composition located inside of the annular shock conditioning shell.

92. The tool of claim 91, wherein the precursor composition comprises an oxidizer, a metal, or a combination thereof.

93. The tool of any one of claims 91-92, wherein the internal shock conditioning shell is configured to impose additional reflection boundaries of reflected shock waves.

94. The tool of any one of claims 91-93, wherein the internal shock conditioning shell has a radius of between about 50% to 90% of the radius of the external tool casing.

95. The tool of any one of claims 91-94, wherein the second precursor composition or second explosive composition is the same as the first precursor composition or the first explosive composition.

96. The tool of any one of claims 91-94, wherein the second precursor composition or second explosive composition is different from the first precursor composition or the first explosive composition.

97. A cylindrical rock fracturing tool comprising:

an exterior annular tool casing;

a ring comprising exploding bridge wires or exploding foil initiators positioned symmetrically around the ring; and an explosive composition.

98. The tool of claim 97, wherein the ring and explosive composition are configured such that the ring produces a uniform detonation wave.

99. The tool of claim 97 or 98, wherein the ring comprises 8 to 48 exploding bridge wires or exploding foil initiators.

100. A down hole modular rock fracturing system comprising:

one or more multiphase explosive containers comprising a precursor composition located down hole;

one or more liquid supply containers comprising liquid fuel;

one or more venting containers;

liquid supply pipes connecting the liquid supply containers to the multiphase explosive containers;

a remote valve or pump located in the liquid supply pipes between the liquid supply containers and the explosive containers thereby separating the liquid fuel from the precursor composition;

a vent pipe connecting the multiphase explosive containers to the venting containers; and a control cable connected to the remote valve or pump, wherein the remote valve is configured to be opened or the pump activated at a signal from the control cable and wherein when the valve is opened or the pump is activate, the liquid fuel moves through the liquid supply pipes into the multiphase explosive containers thereby creating an explosive composition.

101. The system of claim 100, wherein the precursor composition comprises an oxidizer, a metal, or a combination thereof.

102. The system of any one of claims 100-101, wherein the explosive composition comprises an energy density once detonated from 4 kJ/cc to 17 kJ/cc.

103. The system of any one of claims 100-102, wherein the one or more liquid supply containers and the one or more venting containers are located above ground.

104. The system of any one of claims 100-102, wherein the one or more liquid supply containers and the one or more venting containers are located below ground.

105. The system of any one of claims 100-104, wherein one or more multiphase explosive containers is cylindrical and comprises:

a cylindrical outer casing;

a cylindrical intermediate shell; and a cylindrical central shell;

wherein precursor composition is located in the annular space between the outer casing and the intermediate shell and wherein the intermediate shell and central shell comprise fill holes and wherein the central shell is connected to the liquid supply pipes.

106. The system of any one of claims 100-104, wherein one or more multiphase explosive containers is cylindrical and comprises an outer casing;

an internal perforated vent pipe connected to the vent pipe;

a perforated liquid supply pipe connected to the supply pipe;

a precursor composition;

wherein when the multiphase explosive container is angled horizontally, the internal liquid supply pipe is located at the bottom of the container and the internal vent pipe is located at the top of the container such that liquid running through the internal liquid supply pipe exits through the perforations in the internal perforated liquid supply pipe, fills the container, and exits through the internal vent pipe.

107. The system of any one of claims 100-106, wherein two or more of the explosive containers, liquid supply containers, and venting containers located down hole are mechanically coupled together with a mechanical container coupling.

108. The system claim 107, wherein the mechanical container coupling is a split clamp.

109. The system of claim 108, wherein the split clamp comprises a plurality of engaging tooth features located between the split clamp and the exterior of the container, and wherein when mated, a clearance gap is achieved between the engaging teeth to allow for angular misalignment of container central axis.

110. The system of claim 109, wherein the clearance gap between mating teeth is greater than 0.015 inches.

111. The system of claims 100-110, wherein at least two of the explosive containers, liquid supply containers, and venting containers located down hole are internally coupled together with an interior sealing spool.

112. The system of claim 111, wherein the interior sealing spool additionally comprises o-rings, x-rings, or combinations thereof.

113. The system of any one of claims 100-112, wherein the first multiphase container comprises an inner extension portion comprising at least one sealing channel and at least one locking channel and the second multiphase container comprises at least one outer extension portion configured to interlock with the inner extension portion of the first container and comprises at least one sealing channel and at least one locking channel, wherein the sealing and locking channels of the inner and outer extension portions overlay one another and wherein the sealing channel comprises an o-ring and the locking channel comprises rigid locking tape.

In view of the many possible embodiments to which the principles of the present disclosure may be applied, it should be recognized that the illustrated embodiments are only preferred examples of the present disclosure and should not be taken as limiting the scope of the present disclosure. Rather, the scope of the technology is defined by the following claims. We therefore claim all that comes within the scope and spirit of these claims.

We claim:

1. A down hole modular rock fracturing system comprising:

one or more multiphase explosive containers comprising a precursor composition located down hole;

one or more liquid supply containers comprising liquid fuel;

one or more venting containers;

liquid supply pipes connecting the liquid supply containers to the multiphase explosive containers;

a remote valve or pump located in the liquid supply pipes between the liquid supply containers and the explosive containers thereby separating the liquid fuel from the precursor composition;

a vent pipe connecting the multiphase explosive containers to the venting containers; and a control cable connected to the remote valve or pump, wherein the remote valve is configured to be opened or the pump activated at a signal from the control cable and wherein when the valve is opened or the pump is activated, the liquid fuel moves through the liquid supply pipes into the multiphase explosive containers thereby creating an explosive composition;

wherein at least two of the multiphase explosive containers, liquid supply containers, and venting containers are located below ground and are mechanically coupled together downhole with a mechanical container coupling or are internally coupled together with an interior sealing spool.

2. The system of claim 1, wherein the precursor composition comprises an oxidizer, a metal, or a combination thereof.

3. The system of claim 1, wherein the explosive composition comprises an energy density once detonated from 4 kJ/cc to 17 kJ/cc.

4. The system of claim 1, wherein the one or more liquid supply containers and the one or more venting containers are located above ground.

5. The system of claim 1, wherein the one or more liquid supply containers and the one or more venting containers are located below ground.

6. The system of claim 1, wherein one or more of the multiphase explosive containers is cylindrical and comprises:

a cylindrical outer casing;

a cylindrical intermediate shell; and a cylindrical central shell;

wherein precursor composition is located in the annular space between the outer casing and the intermediate shell and wherein the intermediate shell and central shell comprise fill holes; and wherein the central shell is connected to the liquid supply pipes.

7. The system of claim 1, wherein one or more of the multiphase explosive containers is cylindrical and comprises:

an outer casing;

an internal perforated vent pipe connected to the vent pipe;

a perforated liquid supply pipe connected to the supply pipe; and a precursor composition;

wherein when the multiphase explosive container is angled horizontally, the internal liquid supply pipe is located at the bottom of the container and the internal vent pipe is located at the top of the container such that liquid running through the internal liquid supply pipe exits through the perforations in the internal perforated liquid supply pipe, fills the container, and exits through the internal vent pipe.

8. The system of claim 1, wherein two or more of the explosive containers, liquid supply containers, and venting containers located down hole are mechanically coupled together with a mechanical container coupling.

9. The system of claim 8, wherein the mechanical container coupling is a split clamp.

10. The system of claim 9, wherein the split clamp comprises a plurality of engaging tooth features located between the split clamp and the exterior of the container, and wherein when mated, a clearance gap is achieved between the engaging teeth to allow for angular misalignment of container central axis.

11. The system of claim 10, wherein the clearance gap between mating teeth is greater than 0.015 inches.

12. The system of claim 1, wherein at least two of the explosive containers, liquid supply containers, and venting containers located down hole are internally coupled together with an interior sealing spool.

13. The system of claim 12, wherein the interior sealing spool additionally comprises O-rings, x-rings, or combinations thereof.

14. The system of claim 1, wherein the first multiphase container comprises an inner extension portion comprising at least one sealing channel and at least one locking channel and the second multiphase container comprises at least one outer extension portion configured to interlock with the inner extension portion of the first container and comprises at least one sealing channel and at least one locking channel, wherein the sealing and locking channels of the inner and outer extension portions overlay one another and wherein the sealing channel comprises an o-ring and the locking channel comprises rigid locking tape.

15. A down hole modular rock fracturing system comprising:

one or more multiphase explosive containers comprising a precursor composition located down hole;

one or more liquid supply containers comprising liquid fuel;

one or more venting containers;

liquid supply pipes connecting the liquid supply containers to the multiphase explosive containers;

a remote valve or pump located in the liquid supply pipes between the liquid supply containers and the explosive containers thereby separating the liquid fuel from the precursor composition;

a vent pipe connecting the multiphase explosive containers to the venting containers; and a control cable connected to the remote valve or pump, wherein the remote valve is configured to be opened or the pump activated at a signal from the control cable and wherein when the valve is opened or the pump is activated, the liquid fuel moves through the liquid supply pipes into the multiphase explosive containers thereby creating an explosive composition;

wherein one or more of the multiphase explosive containers is cylindrical and comprises:

a cylindrical outer casing;

a cylindrical intermediate shell; and a cylindrical central shell;

wherein precursor composition is located in the annular space between the outer casing and the intermediate shell and wherein the intermediate shell and central shell comprise fill holes; and wherein the central shell is connected to the liquid supply pipes.

16. The system of claim 15, wherein the precursor composition comprises an oxidizer, a metal, or a combination thereof.

17. The system of claim 15, wherein the explosive composition comprises an energy density once detonated from 4 kJ/cc to 17 kJ/cc.

18. A down hole modular rock fracturing system comprising:

one or more multiphase explosive containers comprising a precursor composition located down hole;

one or more liquid supply containers comprising liquid fuel;

one or more venting containers;

liquid supply pipes connecting the liquid supply containers to the multiphase explosive containers;

a remote valve or pump located in the liquid supply pipes between the liquid supply containers and the explosive containers thereby separating the liquid fuel from the precursor composition;

a vent pipe connecting the multiphase explosive containers to the venting containers; and a control cable connected to the remote valve or pump, wherein the remote valve is configured to be opened or the pump activated at a signal from the control cable and wherein when the valve is opened or the pump is activated, the liquid fuel moves through the liquid supply pipes into the multiphase explosive containers thereby creating an explosive composition;

wherein one or more of the multiphase explosive containers is cylindrical and comprises:

an outer casing;

an internal perforated vent pipe connected to the vent pipe;

a perforated liquid supply pipe connected to the supply pipe; and a precursor composition;

wherein when the multiphase explosive container is angled horizontally, the internal liquid supply pipe is located at the bottom of the container and the internal vent pipe is located at the top of the container such that liquid running through the internal liquid supply pipe exits through the perforations in the internal perforated liquid supply pipe, fills the container, and exits through the internal vent pipe.

19. The system of claim 18, wherein the precursor composition comprises an oxidizer, a metal, or a combination thereof.

20. The system of claim 18, wherein the explosive composition comprises an energy density once detonated from 4 kJ/cc to 17 kJ/cc.

* * * * *